US009591737B2

(12) United States Patent
Cheung et al.

(10) Patent No.: US 9,591,737 B2
(45) **Date of Patent: *Mar. 7, 2017**

(54) INDUCTION DEVICES AND METHODS OF USING THEM

(71) Applicant: PERKINELMER HEALTH SCIENCES, INC., Waltham, MA (US)

(72) Inventors: Tak Shun Cheung, Toronto (CA); Chui Ha Cindy Wong, Markham (CA)

(73) Assignee: PerkinElmer Health Sciences, Inc., Waltham, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/087,643

(22) Filed: Mar. 31, 2016

(65) Prior Publication Data

US 2016/0309572 A1 Oct. 20, 2016

Related U.S. Application Data

(63) Continuation of application No. 14/603,480, filed on Jan. 23, 2015, now Pat. No. 9,433,073.

(60) Provisional application No. 61/932,418, filed on Jan. 28, 2014.

(51) Int. Cl.

| | |
|---|---|
| ***H05H 1/32*** | (2006.01) |
| ***H05H 1/30*** | (2006.01) |
| ***H01J 49/10*** | (2006.01) |

(52) U.S. Cl.

CPC ..... *H05H 1/32* (2013.01); *H01J 49/105* (2013.01); *H05H 1/30* (2013.01)

(58) Field of Classification Search

CPC ..... H05H 1/30; H05H 1/3405; H01J 49/26; H01J 49/105

See application file for complete search history.

(56) References Cited

U.S. PATENT DOCUMENTS

| | | | | |
|---|---|---|---|---|
| 5,298,714 | A | 3/1994 | Szente | |
| 2002/0037653 | A1 | 3/2002 | Herchen | |
| 2004/0065645 | A1* | 4/2004 | Welch | H01J 37/32458 219/121.43 |
| 2009/0084502 | A1 | 4/2009 | Hayashi | |
| 2009/0145581 | A1 | 6/2009 | Hoffman | |
| 2011/0162802 | A1 | 7/2011 | Okamura | |
| 2011/0272386 | A1* | 11/2011 | Morrisroe | B23K 10/00 219/121.52 |
| 2012/0000609 | A1 | 1/2012 | Do | |

OTHER PUBLICATIONS

ISR/WO for PCT/US2015/12564 mailed on Apr. 29, 2015.

* cited by examiner

*Primary Examiner* — Douglas W Owens
*Assistant Examiner* — Pedro C Fernandez
(74) *Attorney, Agent, or Firm* — Rhodes IP PLC; Christopher R Rhodes

(57) ABSTRACT

Certain embodiments described herein are directed to induction devices that can be used to sustain a plasma. In certain configurations, the induction device may comprise one or more radial fins electrically coupled to a base. The induction device may take numerous forms including, for example, coils and plate electrodes.

20 Claims, 31 Drawing Sheets

| Parameters | NexION BB6 Tube RFG | BB6 Solid-State RFG | BB6 Solid-State RFG |
|---|---|---|---|
| Load Coil | Original NexION Copper Helix Load Coil | | Pine Cone Load Coil (Aluminum 1100 Alloy) |
| RFG Mode | Oscillation 38MHz | Oscillation 35 MHz | Oscillation 34.9 MHz |
| Be (9) | 8241.3 | 16400 | 12916.3 |
| Mg (24) | 66285.7 | 95300 | 92136.6 |
| In (114.9) | 57969.2 | 128000 | 146338.0 |
| U (238.1) | 43385.9 | 106300 | 88081.7 |
| CeO (155.9) | 767.7 (2.15%) | 2017 (2.12%) | 2027.6 (2.02%) |
| Ce (139.9) | 35646.4 | 95133.5 | 100558.0 |
| Ce++ (70.0) | 1605.2 (4.50%) | 2360 (2.48%) | 1850.4 (1.84%) |
| Bkgd (220) | 1.2 | 2.9 | 0.5 |
| Neb Gas Flow | 1.105 L / min | 1.093 L / min | 0.963 L / min |
| Aux Gas Flow | | 1.2 L / min | |
| Plasma Gas Flow | 17 L / min (argon) | | 14 L / min (argon) |

FIG. 29

INDUCTION DEVICES AND METHODS OF USING THEM

PRIORITY APPLICATION

This application is related to and claims priority to U.S. Provisional Application No. 61/932,418 filed on Jan. 28, 2014, the entire disclosure of which is hereby incorporated herein by reference for all purposes.

TECHNOLOGICAL FIELD

This application is related to induction devices and methods of using them. More particularly, certain embodiments described herein are directed to an induction device comprising one or more radial fins or projections.

BACKGROUND

Induction devices are commonly used to sustain a plasma within a torch body. A plasma includes charged particles. Plasmas may have many uses including atomizing and/or ionizing chemical species.

SUMMARY

In some aspects, a device for sustaining an ionization source in a torch comprising a longitudinal axis along which a flow of gas is introduced during operation of the torch, the device comprising a base configured to provide a coil comprising an inner aperture constructed and arranged to receive a body of the torch, and a radial fin coupled to the base, in which the device is configured to provide radio frequency energy to the body of the torch to sustain the ionization source within the torch is described. In certain embodiments, the radial fin is oriented non-parallel to the longitudinal axis of the torch and extends away from the aperture formed by the base. In other embodiments, the radial fin is orthogonal to the longitudinal axis of the torch. In some examples, the position of the radial fin on the base is adjustable without decoupling the radial fin from the base. In other examples, the radial fin couples to the base through a fastener. In some instances, the radial fin is integrally coupled to the base. In some configurations, the device comprises a plurality of radial fins coupled to the base. In other configurations, at least two of the radial fins comprise the same angle. In some embodiments, each of the plurality of radial fins is angled at substantially the same angle to the base when the base is not coiled. In further embodiments, at least two of the plurality of radial fins are angled at a different angle to the base when the base is not coiled. In some instances, at least two of the plurality of radial fins have a different cross-sectional shape. In other examples, the radial fin comprises at least one aperture in the fin. In some examples, the aperture is configured as a through hole that is positioned substantially parallel to the longitudinal axis of the torch. In further embodiments, the fin aperture is angled toward the aperture formed by the base. In some examples, the device comprises a plurality of radial fins coupled to the base, wherein at least two of the radial fins comprise an aperture in the fins, in which the apertures in the two radial fins are constructed and arranged differently. In other examples, the radial fin is oriented non-parallel to the longitudinal axis of the torch and extends inward within the aperture formed by the base. In some instances, the radial fin is orthogonal to the longitudinal axis of the torch. In further examples, the device comprises a plurality of radial fins coupled to the base, in which each of the plurality of radial fins is oriented non-parallel to the longitudinal axis of the torch and each of the plurality of fins extends inward within the aperture formed by the base. In some embodiments, the device comprises a plurality of radial fins coupled to the base, in which each of the plurality of radial fins is oriented non-parallel to the longitudinal axis of the torch and at least one radial fin extends inward within the aperture formed by the base. In other examples, the device comprises a plurality of radial fins coupled to the base, in which at least one radial fin of the plurality of radial fins extends away from the aperture formed by the base and at least one radial fin of the plurality of radial fins extends inward within the aperture formed by the base. In some examples, the device comprises a spacer configured to engage adjacent radial fins on adjacent turns of the base. In some embodiments, the spacer is configured to retain the adjacent fins in the same plane. In other embodiments, the spacer is configured to retain the adjacent fins in a different plane.

In another aspect, a system for sustaining an ionization source, the system comprising a torch comprising a body comprising a longitudinal axis along which a flow of gas is introduced during operation of the torch, and a device comprising a base constructed and arranged as a coil comprising an inner aperture configured to receive a portion of the torch body, the device further comprising a radial fin coupled to the base, in which the device is configured to provide radio frequency energy to the portion of the torch body received by the aperture to sustain the ionization source within the portion of the torch body is provided.

In certain embodiments, the radial fin is oriented non-parallel to the longitudinal axis of the torch and extends away from the torch body in the aperture. In other embodiments, the radial fin is orthogonal to the longitudinal axis of the torch. In some examples, the position of the radial fin on the base is adjustable without decoupling the radial fin from the base or removing the portion of the torch body within the aperture. In further examples, the radial fin couples to the base through a fastener. In some examples, the radial fin is integrally coupled to the base. In other configurations, the system comprises a plurality of radial fins coupled to the base. In some examples, at least two of the radial fins comprise the same angle. In other embodiments, each of the plurality of radial fins is angled at substantially the same angle to the base when the base is not coiled. In further examples, at least two of the plurality of radial fins are angled at a different angle to the base when the base is not coiled. In some embodiments, at least two of the plurality of radial fins have a different cross-sectional shape. In certain examples, the radial fin comprises at least one aperture in the fin. In some instances, the aperture is configured as a through hole that is positioned substantially parallel to the longitudinal axis of the torch. In certain configurations, the fin aperture is angled toward the aperture formed by the base. In other configurations, the device comprises a plurality of radial fins coupled to the base, wherein at least two of the radial fins comprise an aperture in the fins, in which the apertures in the two radial fins are constructed and arranged differently. In other configurations, the radial fin is oriented non-parallel to the longitudinal axis of the torch and extends inward within the aperture formed by the base. In some embodiments, the radial fin is orthogonal to the longitudinal axis of the torch. In other examples, the system comprises a plurality of radial fins coupled to the base, in which each of the plurality of radial fins is oriented non-parallel to the longitudinal axis of the torch and each of the plurality of fins extends inward within the aperture formed by the base. In some examples, the system comprises a plurality of radial fins coupled to the base, in which each of the plurality of radial fins is oriented non-parallel to the longitudinal axis of the torch and at least one radial fin extends inward within the aperture formed by the base. In further embodiments, the system comprises a plurality of radial fins coupled to the base, in which at least one radial fin of the plurality of radial fins extends away from the aperture formed by the base and at least one radial fin of the plurality of radial fins extends inward within the aperture formed by the base. In additional examples, the system comprises an injector fluidically coupled to the torch and configured to provide sample to the ionization source sustained within the portion of the torch body. In further instances, the system comprises a radio frequency source electrically coupled to the device. In some configurations, the radio frequency source is configured to provide radio frequencies of about 1 MHz to about 1000 MHz at a power of about 10 Watts to about 10,000 Watts. In other configurations, the system comprises a grounding plate electrically coupled to the base of the device. In some examples, the system comprises a detector fluidically coupled to the torch and configured to receive sample from the torch. In further examples, the aperture formed by the base comprises a substantially circular cross-sectional shape. In some configurations, the aperture formed by the base comprises a substantially rectangular cross-sectional shape. In other configurations, the aperture formed by the base comprises a cross-sectional shape other than a substantially circular cross-sectional shape or a substantially rectangular cross-sectional shape. In certain embodiments, the system comprises a plurality of radial fins coupled to the base, in which each of the plurality of radial fins are sized and arranged to be the same. In some instances, the system comprises a plurality of radial fins coupled to the base, in which the radial fins are arranged on the base such that a larger number of radial fins are present toward a proximal end of the base of the device. In some examples, the system comprises a spacer configured to engage adjacent radial fins on adjacent turns of the base. In some embodiments, the spacer is configured to retain the adjacent fins in the same plane. In other embodiments, the spacer is configured to retain the adjacent fins in a different plane.

In an additional aspect, a mass spectrometer comprising a torch comprising a body comprising a longitudinal axis along which a flow of gas is introduced during operation of the torch, a device comprising a base constructed and arranged as a coil comprising an inner aperture configured to receive a portion of the torch body, the device further comprising a radial fin coupled to the base, a radio frequency energy source electrically coupled to the device and configured to provide power to the device to sustain an ionization source within the portion of the torch body in the aperture of the base, and a mass analyzer fluidically coupled to the torch is disclosed.

In certain configurations, the radial fin is oriented non-parallel to the longitudinal axis of the torch and extends away from the torch body in the aperture. In other configurations, the radial fin is orthogonal to the longitudinal axis of the torch. In some embodiments, the position of the radial fin on the base is adjustable without decoupling the radial fin from the base or removing the portion of the torch body within the aperture. In certain examples, the radial fin couples to the base through a fastener. In other embodiments, the radial fin is integrally coupled to the base. In some instances, the system comprises a plurality of radial fins coupled to the base. In some embodiments, at least two of the radial fins comprise the same angle. In other embodiments, each of the plurality of radial fins is angled at substantially the same angle to the base when the base is not coiled. In further embodiments, at least two of the plurality of radial fins are angled at a different angle to the base when the base is not coiled. In some examples, at least two of the plurality of radial fins have a different cross-sectional shape. In other examples, the radial fin comprises at least one aperture in the fin. In some configurations, the aperture is configured as a through hole that is positioned substantially parallel to the longitudinal axis of the torch. In some examples, the fin aperture is angled toward the aperture formed by the base. In other examples, the device comprises a plurality of radial fins coupled to the base, wherein at least two of the radial fins comprise an aperture in the fins, in which the apertures in the two radial fins are constructed and arranged differently. In some embodiments, the radial fin is oriented non-parallel to the longitudinal axis of the torch and extends inward within the aperture formed by the base. In other embodiments, the radial fin is orthogonal to the longitudinal axis of the torch. In additional embodiments, the system comprises a plurality of radial fins coupled to the base, in which each of the plurality of radial fins is oriented non-parallel to the longitudinal axis of the torch and each of the plurality of fins extends inward within the aperture formed by the base. In some examples, the system comprises a plurality of radial fins coupled to the base, in which each of the plurality of radial fins is oriented non-parallel to the longitudinal axis of the torch and at least one radial fin extends inward within the aperture formed by the base. In other examples, the system comprises a plurality of radial fins coupled to the base, in which at least one radial fin of the plurality of radial fins extends away from the aperture formed by the base and at least one radial fin of the plurality of radial fins extends inward within the aperture formed by the base. In additional examples, the system comprises an injector fluidically coupled to the torch and configured to provide sample to the ionization source sustained within the portion of the torch body. In certain configuration, the system comprises a radio frequency source electrically coupled to the device. In other configurations, the radio frequency source is configured to provide radio frequencies of about 1 MHz to about 1000 MHz at a power of about 10 Watts to about 10,000 Watts. In some examples, the system comprises a grounding plate electrically coupled to the base of the device. In other embodiments, the system comprises a detector fluidically coupled to the torch and configured to receive sample from the torch. In further instances, the aperture formed by the base comprises a substantially circular cross-sectional shape. In additional examples, the aperture formed by the base comprises a substantially rectangular cross-sectional shape. In other examples, the aperture formed by the base comprises a cross-sectional shape other than a substantially circular cross-sectional shape or a substantially rectangular cross-sectional shape. In certain embodiments, the system comprises a plurality of radial fins coupled to the base, in which each of the plurality of radial fins are sized and arranged to be the same. In other embodiments, the system comprises a plurality of radial fins coupled to the base, in which the radial fins are arranged on the base such that a larger number of radial fins are present toward a proximal end of the base of the device. In some examples, the system comprises a spacer configured to engage adjacent radial fins on adjacent turns of the base. In some embodiments, the spacer is configured to retain the adjacent fins in the same plane. In other embodiments, the spacer is configured to retain the adjacent fins in a different plane.

In another aspect, a system for detecting optical emission, the system comprising a torch comprising a body comprising a longitudinal axis along which a flow of gas is introduced during operation of the torch, a device comprising a base constructed and arranged as a coil comprising an inner aperture configured to receive a portion of the torch body, the device further comprising a radial fin coupled to the base, a radio frequency energy source electrically coupled to the device and configured to provide power to the device to sustain an ionization source within the portion of the torch body in the aperture of the base, and an optical detector configured to detect optical emissions in the torch is provided.

In certain embodiments, the radial fin is oriented non-parallel to the longitudinal axis of the torch and extends away from the torch body in the aperture. In other embodiments, the radial fin is orthogonal to the longitudinal axis of the torch. In some instances, the position of the radial fin on the base is adjustable without decoupling the radial fin from the base or removing the portion of the torch body within the aperture. In certain configurations, the radial fin couples to the base through a fastener. In other configurations, the radial fin is integrally coupled to the base. In further configurations, the system comprises a plurality of radial fins coupled to the base. In some examples, at least two of the radial fins comprise the same angle. In other instances, each of the plurality of radial fins is angled at substantially the same angle to the base when the base is not coiled. In some embodiments, at least two of the plurality of radial fins are angled at a different angle to the base when the base is not coiled. In some configurations, at least two of the plurality of radial fins have a different cross-sectional shape. In other configurations, the radial fin comprises at least one aperture in the fin. In some embodiments, the aperture is configured as a through hole that is positioned substantially parallel to the longitudinal axis of the torch. In other embodiments, the fin aperture is angled toward the aperture formed by the base. In additional examples, the system comprises a plurality of radial fins coupled to the base, wherein at least two of the radial fins comprise an aperture in the fins, in which the apertures in the two radial fins are constructed and arranged differently. In some examples, the radial fin is oriented non-parallel to the longitudinal axis of the torch and extends inward within the aperture formed by the base. In other examples, the radial fin is orthogonal to the longitudinal axis of the torch. In some examples, the device comprises a plurality of radial fins coupled to the base, in which each of the plurality of radial fins is oriented non-parallel to the longitudinal axis of the torch and each of the plurality of fins extends inward within the aperture formed by the base. In other embodiments, the system comprises a plurality of radial fins coupled to the base, in which each of the plurality of radial fins is oriented non-parallel to the longitudinal axis of the torch and at least one radial fin extends inward within the aperture formed by the base. In additional examples, the system comprises a plurality of radial fins coupled to the base, in which at least one radial fin of the plurality of radial fins extends away from the aperture formed by the base and at least one radial fin of the plurality of radial fins extends inward within the aperture formed by the base. In other embodiments, the system comprises an injector fluidically coupled to the torch and configured to provide sample to the ionization source sustained within the portion of the torch body. In further examples, the system comprises a radio frequency source electrically coupled to the device. In other examples, the radio frequency source is configured to provide radio frequencies of about 1 MHz to about 1000 MHz at a power of about 10 Watts to about 10,000 Watts. In some embodiments, the system comprises a grounding plate electrically coupled to the base of the device. In other embodiments, the system comprises a detector fluidically coupled to the torch and configured to receive sample from the torch. In certain examples, the aperture formed by the base comprises a substantially circular cross-sectional shape. In further embodiments, the aperture formed by the base comprises a substantially rectangular cross-sectional shape. In other embodiments, the aperture formed by the base comprises a cross-sectional shape other than a substantially circular cross-sectional shape or a substantially rectangular cross-sectional shape. In some instances, the system comprises a plurality of radial fins coupled to the base, in which each of the plurality of radial fins are sized and arranged to be the same. In other examples, the system comprises a plurality of radial fins coupled to the base, in which the radial fins are arranged on the base such that a larger number of radial fins are present toward a proximal end of the base of the device. In certain examples, the system comprises a spacer configured to engage adjacent radial fins on adjacent turns of the base. In certain embodiments, the spacer is configured to retain the adjacent fins in the same plane. In other embodiments, the spacer is configured to retain the adjacent fins in a different plane.

In an additional aspect, a system for detecting atomic absorption emission, the system comprising a torch comprising a body comprising a longitudinal axis along which a flow of gas is introduced during operation of the torch, a device comprising a base constructed and arranged as a coil comprising an inner aperture configured to receive a portion of the torch body, the device further comprising a radial fin coupled to the base, a radio frequency energy source electrically coupled to the device and configured to provide power to the device to sustain an ionization source within the portion of the torch body in the aperture of the base, a light source configured to provide light to the torch, and an optical detector configured to measure an amount of the provided light transmitted through the torch is described.

In certain configurations, the radial fin is oriented non-parallel to the longitudinal axis of the torch and extends away from the torch body in the aperture. In other configurations, the radial fin is orthogonal to the longitudinal axis of the torch. In some configurations, the position of the radial fin on the base is adjustable without decoupling the radial fin from the base or removing the portion of the torch body within the aperture. In other configurations, the radial fin couples to the base through a fastener. In further configurations, the radial fin is integrally coupled to the base. In some embodiments, the system comprises a plurality of radial fins coupled to the base. In other embodiments, at least two of the radial fins comprise the same angle. In some examples, each of the plurality of radial fins is angled at substantially the same angle to the base when the base is not coiled. In other examples, at least two of the plurality of radial fins are angled at a different angle to the base when the base is not coiled. In some embodiments, at least two of the plurality of radial fins have a different cross-sectional shape. In other embodiments, the radial fin comprises at least one aperture in the fin. In further examples, the aperture is configured as a through hole that is positioned substantially parallel to the longitudinal axis of the torch. In some embodiments, the fin aperture is angled toward the aperture formed by the base. In some examples, the device of the system further comprises a plurality of radial fins coupled to the base, wherein at least two of the radial fins comprise an aperture in the fins, in which the apertures in the two radial fins are constructed and arranged differently. In certain configurations, the radial fin is oriented non-parallel to the longitudinal axis of the torch and extends inward within the aperture formed by the base. In other configurations, the radial fin is orthogonal to the longitudinal axis of the torch. In certain examples, the system comprises a plurality of radial fins coupled to the base, in which each of the plurality of radial fins is oriented non-parallel to the longitudinal axis of the torch and each of the plurality of fins extends inward within the aperture formed by the base. In some examples, the system comprises a plurality of radial fins coupled to the base, in which each of the plurality of radial fins is oriented non-parallel to the longitudinal axis of the torch and at least one radial fin extends inward within the aperture formed by the base. In other examples, the system comprises a plurality of radial fins coupled to the base, in which at least one radial fin of the plurality of radial fins extends away from the aperture formed by the base and at least one radial fin of the plurality of radial fins extends inward within the aperture formed by the base. In some embodiments, the system comprises an injector fluidically coupled to the torch and configured to provide sample to the ionization source sustained within the portion of the torch body. In other embodiments, the system comprises a radio frequency source electrically coupled to the device. In further instances, the radio frequency source is configured to provide radio frequencies of about 1 MHz to about 1000 MHz at a power of about 10 Watts to about 10,000 Watts. In some configurations, the system comprises a grounding plate electrically coupled to the base of the device. In other configurations, the system comprises a detector fluidically coupled to the torch and configured to receive sample from the torch. In certain embodiments, the aperture formed by the base comprises a substantially circular cross-sectional shape. In some examples, the aperture formed by the base comprises a substantially rectangular cross-sectional shape. In certain examples, the aperture formed by the base comprises a cross-sectional shape other than a substantially circular cross-sectional shape or a substantially rectangular cross-sectional shape. In some embodiments, the system comprises a plurality of radial fins coupled to the base, in which each of the plurality of radial fins are sized and arranged to be the same. In other embodiments, the system comprises a plurality of radial fins coupled to the base, in which the radial fins are arranged on the base such that a larger number of radial fins are present toward a proximal end of the base of the device. In certain examples, the system comprises a spacer configured to engage adjacent radial fins on adjacent turns of the base. In certain embodiments, the spacer is configured to retain the adjacent fins in the same plane. In other embodiments, the spacer is configured to retain the adjacent fins in a different plane.

In another aspect, a chemical reactor system comprising a reaction chamber, a device comprising a base constructed and arranged as a coil comprising an inner aperture configured to receive a portion of the reaction chamber, the device further comprising a radial fin coupled to the base, and a radio frequency energy source electrically coupled to the device and configured to provide power to the device to sustain an ionization source within the portion of the reaction chamber in the aperture of the base is provided.

In certain configurations, the radial fin is oriented non-parallel to a longitudinal axis of the reaction chamber and extends away from the aperture. In other configurations, the radial fin is orthogonal to the longitudinal axis of the reaction chamber. In some embodiments, the position of the radial fin on the base is adjustable without decoupling the radial fin from the base or removing the portion of the reaction chamber within the aperture. In certain examples, the radial fin couples to the base through a fastener. In other examples, the radial fin is integrally coupled to the base. In additional examples, the system comprises a plurality of radial fins coupled to the base. In some embodiments, at least two of the radial fins comprise the same angle. In other embodiments, each of the plurality of radial fins is angled at substantially the same angle to the base when the base is not coiled. In certain examples, at least two of the plurality of radial fins are angled at a different angle to the base when the base is not coiled. In further embodiments, at least two of the plurality of radial fins have a different cross-sectional shape. In some examples, the radial fin comprises at least one aperture in the fin. In other examples, the aperture is configured as a through hole that is positioned substantially parallel to the longitudinal axis of the reaction chamber. In some examples, the fin aperture is angled toward the aperture formed by the base. In further embodiments, the device of the system comprises a plurality of radial fins coupled to the base, wherein at least two of the radial fins comprise an aperture in the fins, in which the apertures in the two radial fins are constructed and arranged differently. In some instances, the radial fin is oriented non-parallel to the longitudinal axis of the reaction chamber and extends inward within the aperture formed by the base. In other instances, the radial fin is orthogonal to the longitudinal axis of the reaction chamber. In further examples, the system comprises a plurality of radial fins coupled to the base, in which each of the plurality of radial fins is oriented non-parallel to the longitudinal axis of the reaction chamber and each of the plurality of fins extends inward within the aperture formed by the base. In some configurations, the system comprises a plurality of radial fins coupled to the base, in which each of the plurality of radial fins is oriented non-parallel to the longitudinal axis of the reaction chamber and at least one radial fin extends inward within the aperture formed by the base. In other configurations, the system comprises a plurality of radial fins coupled to the base, in which at least one radial fin of the plurality of radial fins extends away from the aperture formed by the base and at least one radial fin of the plurality of radial fins extends inward within the aperture formed by the base. In certain embodiments, the system comprises an injector fluidically coupled to the reaction chamber and configured to provide a reactant to the ionization source sustained within the reaction chamber. In further examples, the system comprises a radio frequency source electrically coupled to the device. In some instances, the radio frequency source is configured to provide radio frequencies of about 1 MHz to about 1000 MHz at a power of about 10 Watts to about 10,000 Watts. In certain embodiments, the system comprises a grounding plate electrically coupled to the base of the device. In other embodiments, the system comprises a detector fluidically coupled to the reaction chamber and configured to receive reactant products from the reaction chamber. In some configurations, the aperture formed by the base comprises a substantially circular cross-sectional shape or a substantially rectangular cross-sectional shape or a shape other than a substantially circular cross-sectional shape or a substantially rectangular cross-sectional shape. In some embodiments, the system comprises a plurality of radial fins coupled to the base, in which each of the plurality of radial fins are sized and arranged to be the same. In some arrangements, the system comprises a plurality of radial fins coupled to the base, in which the radial fins are arranged on the base such that a larger number of radial fins are present toward a proximal end of the base of the device. In certain examples, the system comprises a spacer configured to engage adjacent radial fins on adjacent turns of the base. In certain embodiments, the spacer is configured to retain the adjacent fins in the same plane. In other embodiments, the spacer is configured to retain the adjacent fins in a different plane.

In an additional aspect, a material deposition system comprising an atomization chamber, a device comprising a base constructed and arranged as a coil comprising an inner aperture configured to receive a portion of the atomization chamber, the device further comprising a radial fin coupled to the base, a radio frequency energy source electrically coupled to the device and configured to provide power to the device to sustain an ionization source within the portion of the atomization chamber in the aperture of the base, and a nozzle fluidically coupled to the atomization chamber and configured to receive atomized species from the chamber and provide the received, atomized species towards a substrate is described.

In some configurations, the radial fin is oriented non-parallel to a longitudinal axis of the atomization chamber and extends away from the aperture. In other configurations, the radial fin is orthogonal to the longitudinal axis of the atomization chamber. In further configurations, the position of the radial fin on the base is adjustable without decoupling the radial fin from the base or removing the portion of the atomization chamber within the aperture. In some embodiments, the radial fin couples to the base through a fastener. In other embodiments, the radial fin is integrally coupled to the base. In further instances, the system comprises a plurality of radial fins coupled to the base. In some embodiments, at least two of the radial fins comprise the same angle. In other examples, each of the plurality of radial fins is angled at substantially the same angle to the base when the base is not coiled. In further examples, at least two of the plurality of radial fins are angled at a different angle to the base when the base is not coiled. In some embodiments, at least two of the plurality of radial fins have a different cross-sectional shape. In other embodiments, the radial fin comprises at least one aperture in the fin. In some instances, the aperture is configured as a through hole that is positioned substantially parallel to the longitudinal axis of the atomization chamber. In additional examples, the fin aperture is angled toward the aperture formed by the base. In further embodiments, the device comprises a plurality of radial fins coupled to the base, wherein at least two of the radial fins comprise an aperture in the fins, in which the apertures in the two radial fins are constructed and arranged differently. In other examples, the radial fin is oriented non-parallel to the longitudinal axis of the atomization chamber and extends inward within the aperture formed by the base. In certain examples, the radial fin is orthogonal to the longitudinal axis of the atomization chamber. In some embodiments, the system comprises a plurality of radial fins coupled to the base, in which each of the plurality of radial fins is oriented non-parallel to the longitudinal axis of the atomization chamber and each of the plurality of fins extends inward within the aperture formed by the base. In other embodiments, the system comprises a plurality of radial fins coupled to the base, in which each of the plurality of radial fins is oriented non-parallel to the longitudinal axis of the atomization chamber and at least one radial fin extends inward within the aperture formed by the base. In additional embodiments, the system comprises a plurality of radial fins coupled to the base, in which at least one radial fin of the plurality of radial fins extends away from the aperture formed by the base and at least one radial fin of the plurality of radial fins extends inward within the aperture formed by the base. In other embodiments, the system comprises an injector fluidically coupled to the atomization chamber and configured to provide a reactant to the ionization source sustained within the atomization chamber. In further instances, the system comprises a radio frequency source electrically coupled to the device. In other examples, the radio frequency source is configured to provide radio frequencies of about 1 MHz to about 1000 MHz at a power of about 10 Watts to about 10,000 Watts. In some configurations, the system comprises a grounding plate electrically coupled to the base of the device. In certain embodiments, the system comprises a detector fluidically coupled to the atomization chamber and configured to receive reactant products from the atomization chamber. In further examples, the aperture formed by the base comprises a substantially circular cross-sectional shape or a substantially rectangular cross-sectional shape or a cross-sectional shape other than a substantially circular cross-sectional shape or a substantially rectangular cross-sectional shape. In some examples, the system comprises a plurality of radial fins coupled to the base, in which each of the plurality of radial fins are sized and arranged to be the same. In other embodiments, the system comprises a plurality of radial fins coupled to the base, in which the radial fins are arranged on the base such that a larger number of radial fins are present toward a proximal end of the base of the device. In certain examples, the system comprises a spacer configured to engage adjacent radial fins on adjacent turns of the base. In certain embodiments, the spacer is configured to retain the adjacent fins in the same plane. In other embodiments, the spacer is configured to retain the adjacent fins in a different plane.

In another aspect, a device for sustaining an ionization source in a torch comprising a longitudinal axis along which a flow of gas is introduced during operation of the torch, the device comprising a plate electrode comprising an inner aperture constructed and arranged to receive a body of the torch, and a radial fin coupled to the plate electrode, in which the plate electrode is configured to provide radio frequency energy to the body of the torch to sustain the ionization source within the torch is described.

In some examples, the radial fin is oriented non-parallel to the longitudinal axis of the torch and extends away from the aperture of the plate electrode. In other examples, the radial fin is orthogonal to the longitudinal axis of the torch. In certain embodiments, the position of the radial fin on the plate electrode is adjustable without decoupling the radial fin from the plate electrode. In some configurations, the radial fin couples to the plate electrode through a fastener. In other configurations, the radial fin is integrally coupled to the plate electrode. In certain embodiments, the system comprises a plurality of radial fins coupled to the plate electrode. In other embodiments, at least two of the radial fins comprise the same angle. In some examples, each of the plurality of radial fins is angled at substantially the same angle. In certain embodiments, at least two of the plurality of radial fins are angled at a different angle. In some examples, at least two of the plurality of radial fins have a different cross-sectional shape. In certain embodiments, the radial fin comprises at least one aperture in the fin. In some examples, the aperture is configured as a through hole that is positioned substantially parallel to the longitudinal axis of the torch. In other examples, the fin aperture is angled toward the aperture of the plate electrode. In some embodiments, the device comprises a plurality of radial fins coupled to the plate electrode, wherein at least two of the radial fins comprise an aperture in the fins, in which the apertures in the two radial fins are constructed and arranged differently. In other embodiments, the radial fin is oriented non-parallel to the longitudinal axis of the torch and extends inward within the aperture of the plate electrode. In certain examples, the radial fin is orthogonal to the longitudinal axis of the torch. In other embodiments, the system comprises a plurality of radial fins coupled to the plate electrode, in which each of the plurality of radial fins is oriented non-parallel to the longitudinal axis of the torch and each of the plurality of fins extends inward within the aperture of the plate electrode. In further examples, the system comprises a plurality of radial fins coupled to the plate electrode, in which each of the plurality of radial fins is oriented non-parallel to the longitudinal axis of the torch and at least one radial fin extends inward within the aperture of the plate electrode. In some examples, the system comprises a second plate electrode comprising an inner aperture constructed and arranged to receive a body of the torch, and a radial fin coupled to the second plate electrode, in which the second plate electrode is configured to provide radio frequency energy to the body of the torch to sustain the ionization source within the torch. In certain examples, the system comprises a spacer configured to engage adjacent radial fins on adjacent turns of the base. In certain embodiments, the spacer is configured to retain the adjacent fins in the same plane. In other embodiments, the spacer is configured to retain the adjacent fins in a different plane.

In an additional aspect, a system for sustaining an ionization source, the system comprising a torch comprising a body comprising a longitudinal axis along which a flow of gas is introduced during operation of the torch, and a plate electrode comprising an inner aperture constructed and arranged to receive a body of the torch and a radial fin coupled to the plate electrode, in which the plate electrode is configured to provide radio frequency energy to the body of the torch to sustain the ionization source within the torch is provided.

In certain examples, the radial fin is oriented non-parallel to the longitudinal axis of the torch and extends away from the torch body in the aperture. In other examples, the radial fin is orthogonal to the longitudinal axis of the torch. In additional examples, the position of the radial fin is adjustable without decoupling the radial fin from the plate electrode or removing the portion of the torch body within the aperture. In some examples, the radial fin couples to the plate electrode through a fastener. In other examples, the radial fin is integrally coupled to the plate electrode. In further embodiments, the system comprises a plurality of radial fins coupled to the plate electrode. In other embodiments, at least two of the radial fins comprise the same angle. In some instances, each of the plurality of radial fins is angled at substantially the same angle. In other examples, at least two of the plurality of radial fins are angled at a different angle to the base. In further embodiments, at least two of the plurality of radial fins have a different cross-sectional shape. In some examples, the radial fin comprises at least one aperture in the fin. In certain configurations, the aperture is configured as a through hole that is positioned substantially parallel to the longitudinal axis of the torch. In other configurations, the fin aperture is angled toward the aperture. In some embodiments, the system comprises a plurality of radial fins coupled to the plate electrode, wherein at least two of the radial fins comprise an aperture in the fins, in which the apertures in the two radial fins are constructed and arranged differently. In other configurations, the radial fin is oriented non-parallel to the longitudinal axis of the torch and extends inward within the aperture of the plate electrode. In additional configurations, the radial fin is orthogonal to the longitudinal axis of the torch. In some embodiments, the system comprises a plurality of radial fins coupled to the plate electrode, in which each of the plurality of radial fins is oriented non-parallel to the longitudinal axis of the torch and each of the plurality of fins extends inward within the aperture of the plate electrode. In other embodiments, the system comprises a plurality of radial fins coupled to the plate electrode, in which each of the plurality of radial fins is oriented non-parallel to the longitudinal axis of the torch and at least one radial fin extends inward within the aperture formed by the base. In additional embodiments, the system comprises a plurality of radial fins coupled to the plate electrode, in which at least one radial fin of the plurality of radial fins extends away from the aperture of the plate electrode and at least one radial fin of the plurality of radial fins extends inward within the aperture of the plate electrode. In some instances, the system comprises an injector fluidically coupled to the torch and configured to provide sample to the ionization source sustained within the portion of the torch body. In other configurations, the system comprises a radio frequency source electrically coupled to the device. In some embodiments, the radio frequency source is configured to provide radio frequencies of about 1 MHz to about 1000 MHz at a power of about 10 Watts to about 10,000 Watts. In certain examples, the system comprises a grounding plate electrically coupled to the base of the device. In other embodiments, the system comprises a detector fluidically coupled to the torch and configured to receive sample from the torch. In certain instances, the aperture of the plate electrode comprises a substantially circular cross-sectional shape or a substantially rectangular cross-sectional shape. In other instances, the aperture of the plate electrode comprises a cross-sectional shape other than a substantially circular cross-sectional shape or a substantially rectangular cross-sectional shape. In some embodiments, the system comprises, a plurality of radial fins coupled to the plate electrode, in which each of the plurality of radial fins are sized and arranged to be the same. In some configurations, the system comprises a plurality of radial fins coupled to the plate electrode, in which the radial fins are arranged on the plate electrode such that a larger number of radial fins are present on one side of the aperture. In other embodiments, the system comprises a second plate electrode comprising an inner aperture constructed and arranged to receive a body of the torch, and a radial fin coupled to the second plate electrode, in which the second plate electrode is configured to provide radio frequency energy to the body of the torch to sustain the ionization source within the torch. In some examples, the system comprises a spacer configured to engage adjacent radial fins on adjacent turns of the base. In some embodiments, the spacer is configured to retain the adjacent fins in the same plane. In other embodiments, the spacer is configured to retain the adjacent fins in a different plane.

Additional features, aspects, examples and embodiments are described in more detail below.

BRIEF DESCRIPTION OF THE DRAWINGS

Certain embodiments of the devices and systems are described with reference to the accompanying figures in which:

FIG. 29 is a table showing various measurements using a finned induction device and a helical load coil, in accordance with certain configurations;

It will be recognized by the person of ordinary skill in the art, given the benefit of this disclosure, that certain dimensions or features of the components of the systems may have been enlarged, distorted or shown in an otherwise unconventional or non-proportional manner to provide a more user friendly version of the figures. In addition, the exact length, width, geometry, aperture size, etc. of the induction device, the plasmas generated and other components herein may vary.

DETAILED DESCRIPTION

Certain embodiments are described below with reference to singular and plural terms in order to provide a user friendly description of the technology disclosed herein. These terms are used for convenience purposes only and are not intended to limit the devices, methods and systems described herein. Certain examples are described herein with reference to induction devices. While the exact parameters used to power the induction devices may vary, the induction device can be electrically coupled to an RF generator that provides radio frequencies, for example, from 10 MHz to 90 MHz, more particularly between 20 MHz and 50 MHz, for example about 40 MHz. The RF generator output power is typically about 500 Watts to 50 kW. Two or more induction devices may be present with each induction device electrically coupled to a common RF generator or electrically coupled to separate RF generators.

In some embodiments, the RF generator used with the induction devices described herein may be a hybrid generator as described in commonly owned U.S. Provisional Application No. 61/894,560 filed on Oct. 23, 2013, the entire disclosure of which is hereby incorporated herein by reference for all purposes. The induction devices can be used in many different instruments and devices including, but not limited to, ICP-OES or ICP-MS or other similar instruments as described herein. In certain embodiments, generator operation can be controlled with a processor or master controller in or electrically coupled to the generator to control the generator, e.g., to enable or terminate the plasma generation. Certain embodiments are also described below that use an induction device to generate and/or sustain an inductively coupled plasma. If desired, however, the same induction device can be used (either alone or with another device) to generate and/or sustain a capacitively coupled plasma, a flame or other atomization/ionization devices that can be used, for example, to atomize and/or ionize chemical species. Certain configurations are provided below using inductively coupled plasmas to illustrate various aspects and attributes of the technology described herein. The radial fins described can extend inward toward a torch within an induction device comprising the radial fins, can extend outward away from a torch within an induction device comprising the radial fins, or certain fins may extend inward and other fins may extend outward.

Figure 1:
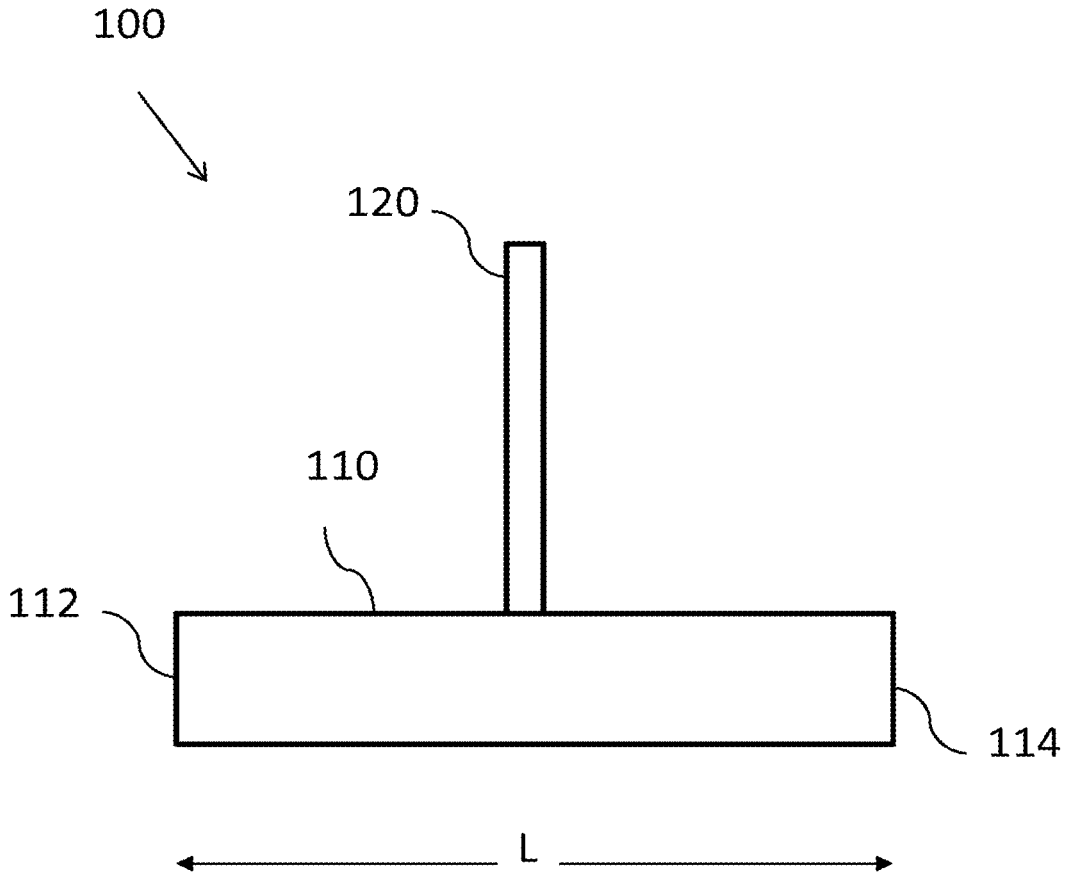
FIG. 1 is a simplified illustration of a side view of an induction device, in accordance with certain embodiments.
Figure 2A:
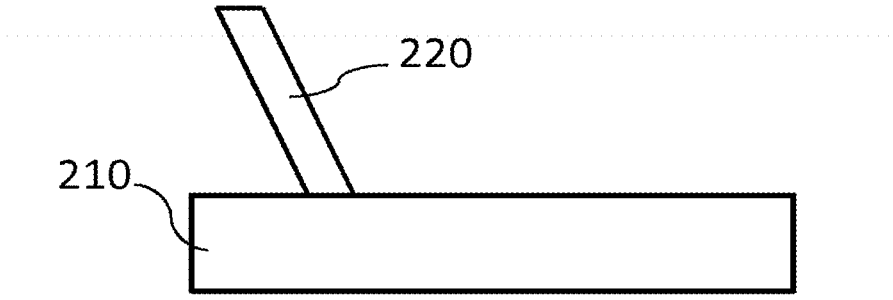
FIGS. 2A-2C show induction devices with fins positioned at different angles, in accordance with certain configurations.
Figure 2B:
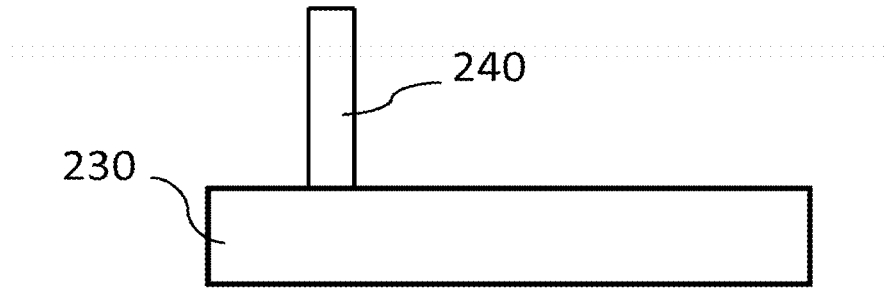
Figure 2C:
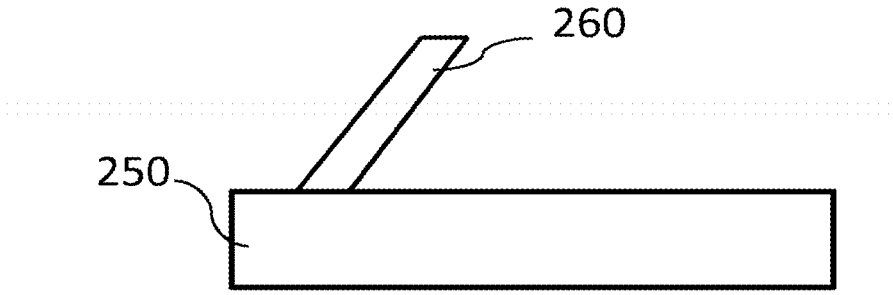

In certain examples, the induction devices described herein can be used to sustain a high-energy plasma to atomize and/or ionize samples for chemical analysis, to provide ions for deposition or other uses. To ignite and sustain the plasma, RF power, typically in the range of 0.5 kW to 100 kW, from a RF generator (RFG) is inductively coupled to the plasma through the induction device. Referring to FIG. 1, an induction device 100 is shown in an uncoiled or extended form for illustration. The device 100 comprises a base 110 that includes a generally solid or hollow body shown being positioned along a longitudinal axis L for spatial reference. The base 110 may be sized and arranged to be flexible enough to permit coiling of the base to form an inner aperture that can receive a portion of a torch body as noted in more detail below. The base 110 is electrically coupled to a radial fin 120 which extends (when the induction device 100 is in the extended form) generally outward in a non-parallel direction to the longitudinal axis L of the coiled induction device. The exact angle present between the fin 120 and the base 110 may vary from greater than 0 degrees to less than 180 degrees, more particularly, the angle between the base 110 and the fin 120 may vary from about 30 degrees to about 150 degrees, e.g., about 45 degrees to about 135 degrees or about 60 degrees to about 120 degrees or about 75 degrees to about 105 degrees or about 85 degrees to about 95 degrees. In some embodiments, the fin 120 is orthogonal to the base 110 when the induction device 100 is in an extended form. Referring to FIGS. 2A-2C, in some configurations a fin 220 may be acutely angled (FIG. 2A) relative to a base 210 such that the angle between the fin 220 and the base 210 is between 0 and 90 degrees. Alternatively, a fin 240 may be orthogonal to a base 230 as shown in FIG. 2B. A fin 260 may also be obtusely angled, e.g., between 90 degrees and 180 degrees, relative to a base 250 (FIG. 2C).

Referring again to FIG. 1, the position of the fin 120 along the base 110 may vary. For example, the fin 120 may be positioned closer to an end 112 of the base 110 than to an end 114 of the base 110. The fin 120 may be integrally coupled to the base 110 such that a generally solid unitary structure is present, or the fin 120 may be coupled to the base 110 through an adhesive, weld, solder joint, screw, pin or other means as described herein. In some embodiments, the base 110 may be configured to permit location and/or relocation of the fin 120. For example, the base 110 may be configured with a plurality of positions, e.g., slots or holes, each of which is configured to couple to the fin 120 through a suitable coupler, e.g., screw, pin, etc. The fin 120 can be located at a desired position along the base 110 and coupled to the base 110, for at least some period, through the coupler. Similarly, the base 110 may be configured to permit adjustment of the angle of the fin 120 relative to the base 110. In some instances, one or more conductive spacers may be placed between the fin 120 and the base 110 to adjust the angle between the base 110 and the fin 120. For example, a conductive wedge can be placed between the base 110 and the fin 120 prior to coupling to alter the angle between the base 110 and the fin 120. In some instances, the base 110 may comprise an internal track designed to receive the fin 120. For example, the internal track may include a groove that is sized and arranged to receive the fin 120 such that the fin 120 can engage the track and slide down the track to a desired position. Once positioned at a desired site along the base 110, the fin 120 may be coupled using a suitable coupler. Alternatively, the size and dimensions of the track may be selected to provide a tight friction fit such that engagement of the fin by the track permits movement of the fin using a suitable force but does not generally permit the fin to fall out under the force of gravity.

Figure 3A:
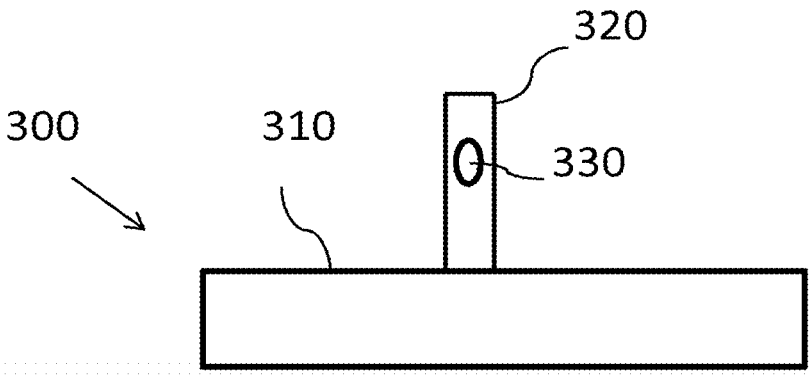
FIGS. 3A-3E show induction devices which include a through hole or aperture in a fin, in accordance with certain configurations.
Figure 3B:
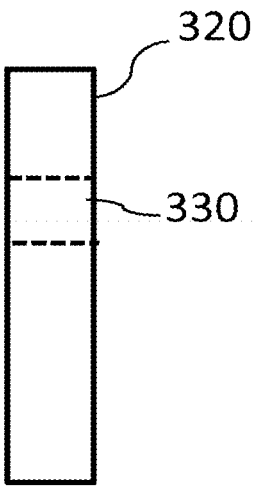
Figure 3C:
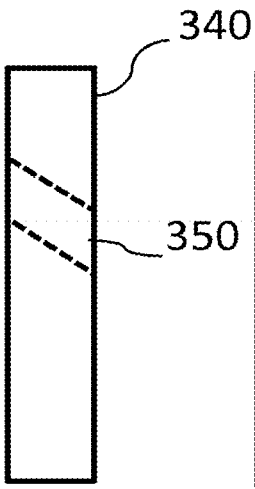
Figure 3D:
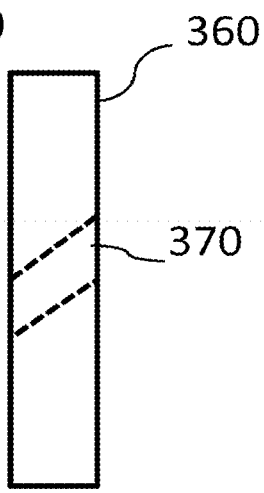
Figure 3E:
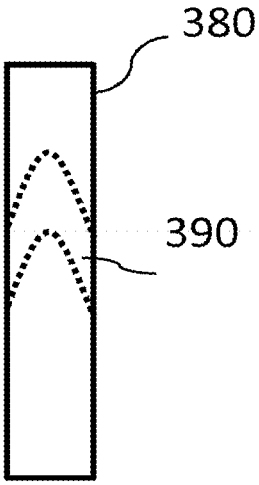

In certain examples, the fin may include one or more through-holes or apertures. Referring to FIGS. 3A and 3B, a simplified illustration of an induction device comprising a fin with an aperture is shown. The induction device 300 comprises a base 310 electrically coupled to a fin 320. The fin 320 comprises an aperture or through hole 330 that generally provides an opening from one side of the fin 320 to the other side of the fin 320 (see FIG. 3B). If desired, the fin 320 may include more than a single aperture 330, e.g., may include two, three, four or more apertures. While not wishing to be bound by any particular scientific theory, the aperture 330 of the fin may permit a cooling gas or fluid to enter and pass through the fin 320 to assist in cooling of the induction device 300. The angle of the aperture can vary. Referring to FIG. 3B, the aperture 330 has a zero angle such that the position of the entrance and exit are generally in the same x-y plane. If desired, however, the aperture may be angled. For example and referring to FIG. 3C, a fin 340 comprises an aperture 350 that is angled downward such that the exit of the aperture 350 is positioned lower along the fin 340 than the entrance of the aperture 350. Referring to FIG. 3D, a fin 360 comprises an upwardly angled aperture 370 such that the entrance of the aperture 370 is positioned lower along the fin 360 than the exit of the aperture 370. In some instances, the entrance and exit of the aperture may be positioned similarly, and the internal channel or pathway formed by the aperture may be curved or angled. For example and referring to FIG. 3E, an aperture 390 in a fin 380 is shown where the exit and entrance apertures are positioned at about the same location along the body of the fin 380. The internal geometry of the aperture 390 angles upward and then downward from entrance to exit. It may be desirable to adopt different internal geometries within the fin to slow the flow of gas through the fins to increase the time and/or surface area available to transfer heat from the fin to the gas. If desired, the geometry and/or size of the channel may be selected to provide an audible indication that cooling gas is flowing through the aperture and/or device. For example, passage of gas through the apertures may provide a noise or "whistling" effect and provide an audible cue that the induction device is being properly cooled.

Figure 4:
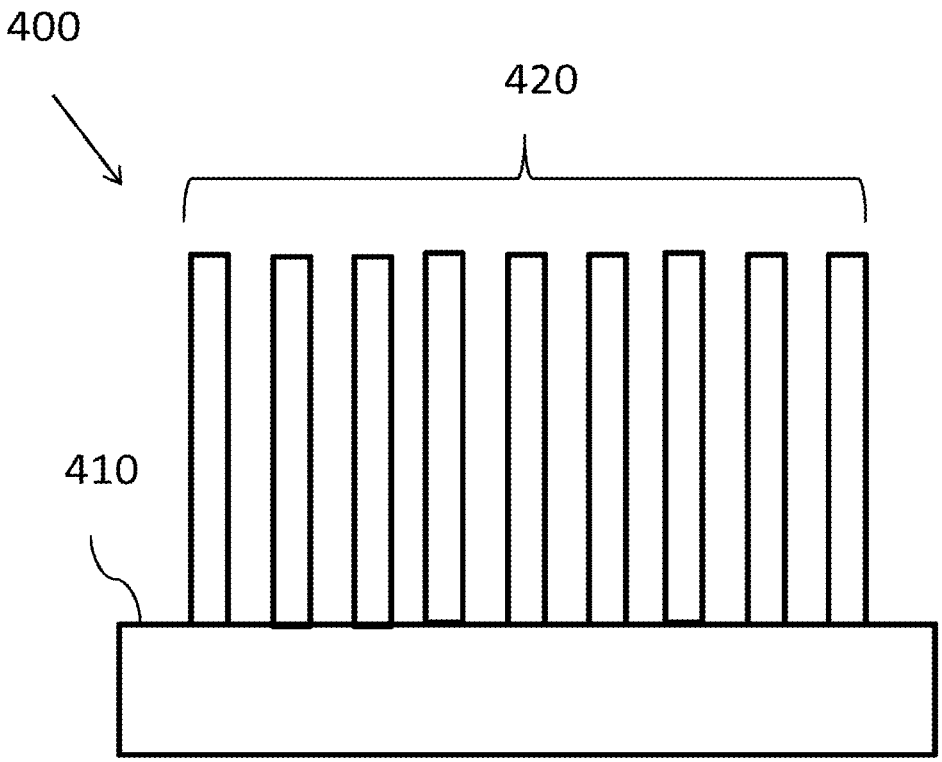
FIG. 4 shows an induction device comprising a plurality of fins, in accordance with certain configurations.
Figure 5:
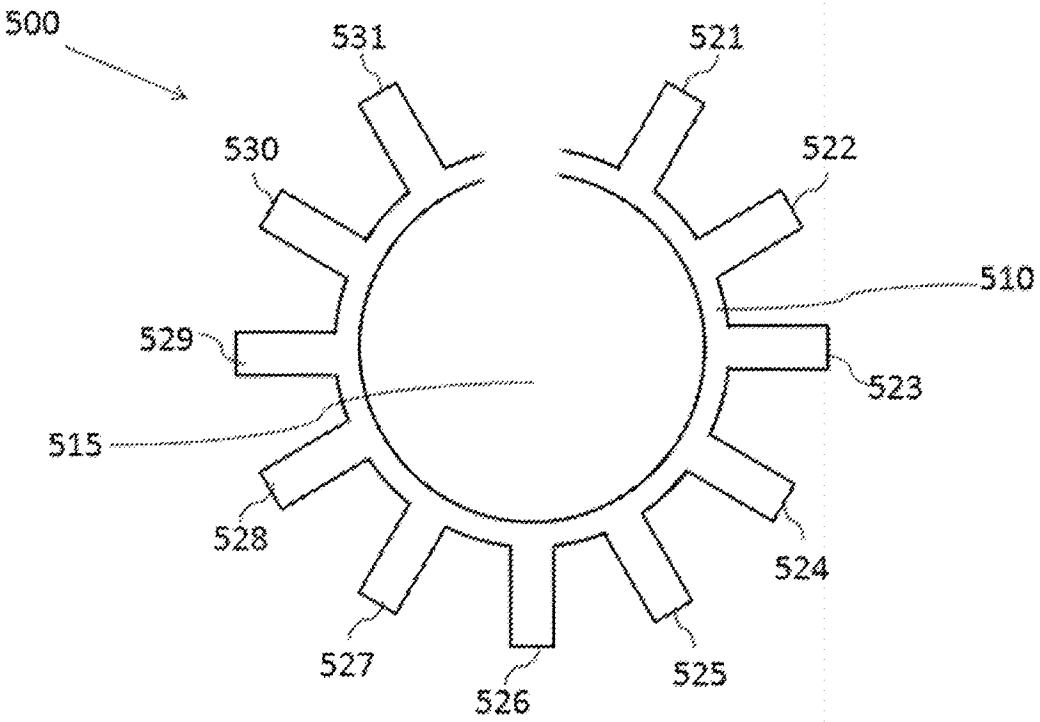
FIG. 5 shows an induction device comprising a plurality of fins and where the induction device has been coiled, in accordance with certain configurations.

In certain embodiments, the induction devices described herein may comprise a base structure coupled to a plurality of fins. Referring to FIG. 4, an induction device 400 is shown in an extended form that comprises a base 410 electrically coupled to a plurality of fins (grouped as element 420). The fins 420 are generally sized and arranged to be the same and are spaced about the same distance from each other. While nine fins are shown in the induction device 400, fewer than nine fins, e.g., 2, 3, 4, 5, 6, 7 or 8 fins may be present, or more than nine fins may be present. Where a plurality of fins are present, the fins can permit a cooling gas to flow around them to provide forced-air or convection cooling. The fins permit such cooling while reducing the likelihood of eddy currents that may oppose the magnetic field provided by the induction device. The fins provide an increase in surface area while still permitting a cooling gas to flow on or around the induction device. For example and referring to FIG. 5, one turn of an induction device 500 is shown in a coiled form. The induction device 500 comprises a base structure 510 and a plurality of radial fins 521-531. When coiled, the base 510 provides a central aperture 515 that is sized and arranged to receive a torch (not shown), as described in more detail below. The base 510 wraps around the torch so that the longitudinal axis of the torch is nearly orthogonal to the direction of the fins 521-531. The fins 521-531 extend radially away from the longitudinal axis of the torch. Together, the base 510 and the fins 521-531 can provide RF energy into the torch to sustain a plasma within the torch. The fin-to-fin spacing of the fins 521-531 can be selected to permit cooling around the induction device 500 while still maintaining a suitable magnetic field to provide energy into the torch to sustain the plasma. In some embodiments, the base 510 and the fins 521-531 may be hollow such that a cooling gas can be introduced internally within the induction device 500, whereas in other examples, the base 510 and/or fins 521-531 may be solid such that cooling gas is provided only to external surfaces of the induction device 500.

Figure 6A:
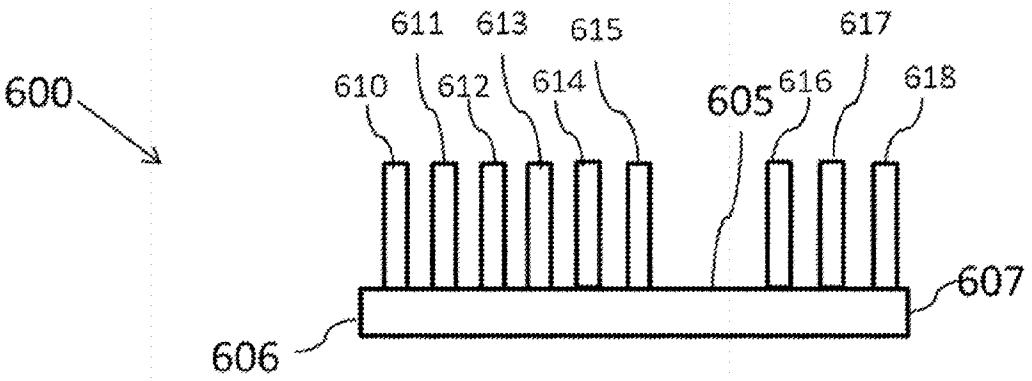
FIGS. 6A-6C shows side views of induction devices where the fin spacing along the length of the induction device has been varied, in accordance with certain configurations.
Figure 6B:
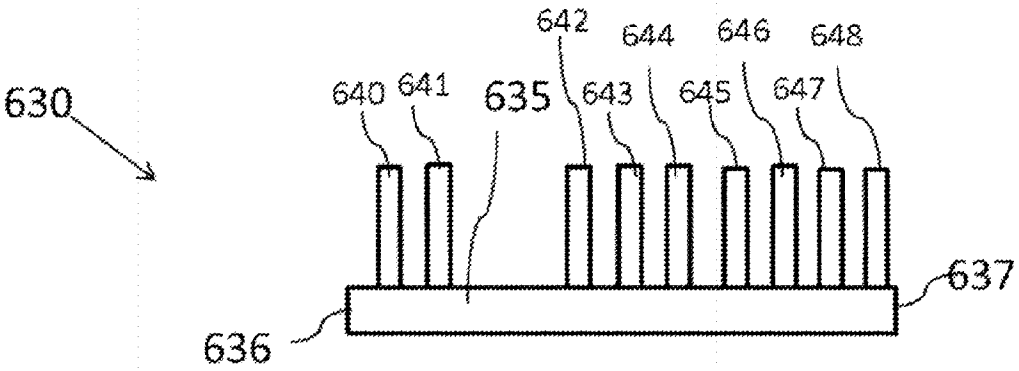
Figure 6C:
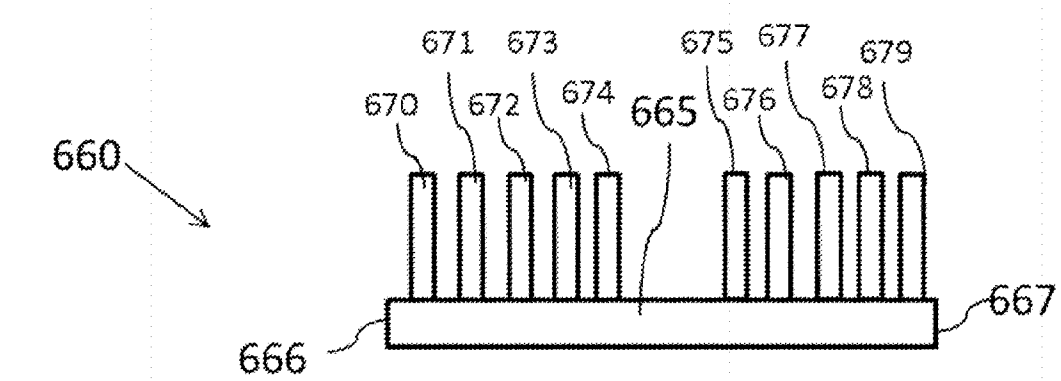

In some embodiments, the spacing of the fins along the length of the base may differ. For example and referring to FIG. 6A, an induction device 600 is shown that comprises a base 605 electrically coupled to fins 610-618. More fins are located toward a proximal end 606 than located at a distal end 607. Referring to FIG. 6B, an induction device 630 is shown that comprises a base 635 electrically coupled to fins 640-648. More fins are located toward a distal end 637 than a proximal end 636. Referring to FIG. 6C, an induction device 660 is shown that comprises a base 665 electrically coupled to fins 670-679. More fins are located toward the proximal end 666 and the distal end 667 than in the center of the base 665. By positioning different numbers of fins at different portions along the base of the induction device, it may be possible to tune, control or provide different magnetic fields to the torch at different portions of the torch. For example, by positioning a plurality of fins at each end of an induction device, the magnetic field provided by the center of the induction device may differ from the magnetic fields provided at the ends of the induction device.

Figure 7:
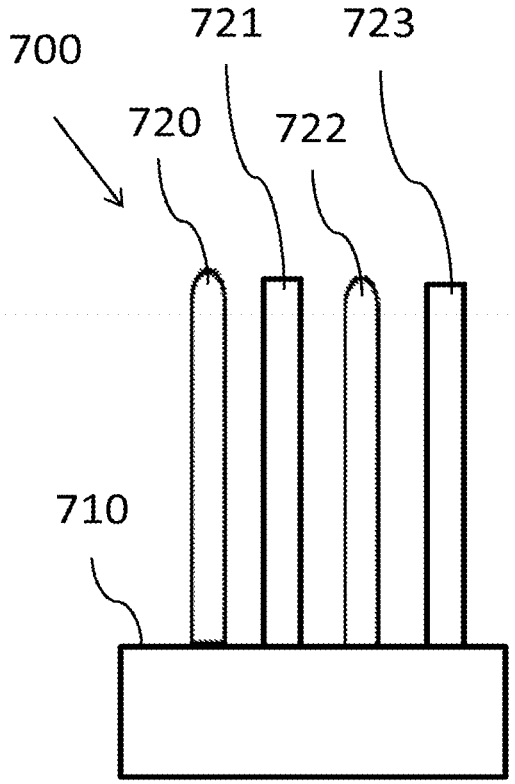
FIG. 7 shows a side view of an induction device having differently shaped fins, in accordance with certain configurations.

In certain configurations, the shape of all the fins need not be the same shape. Referring to FIG. 7, an induction device 700 is shown that comprises a base 710 electrically coupled to a plurality of fins. Fins 720 and 722 have a different shape than fins 721 and 723. In particular, the ends of fins 720 and 722 are more rounded than the sharp ends present on fins 721 and 723. While not wishing to be bound by any particular theory, rounded ends may be more desirable to avoid creation of turbulent cooling gas flows around the induction device 700. In some examples, all fins of the induction device may have substantially the same shape. In other configurations, at least one fin present in the induction device is shaped differently than another fin present in the induction device. In some instances, two different shapes are present for the fins of the induction device. In other instances, three or more different shapes are present for the fins of the induction device. Fins with a similar shape may be positioned adjacent to each other or may be spaced apart by one or more fins with a different shape.

Figure 8B:
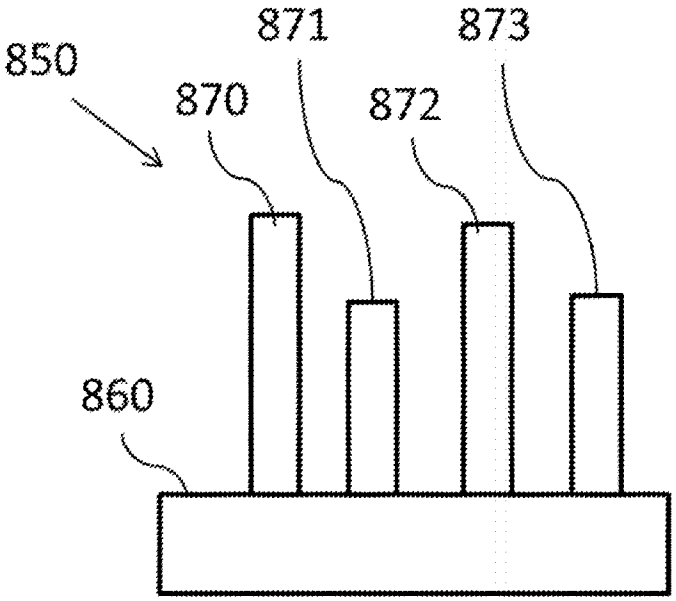
FIGS. 8A and 8B shows side views of an induction device having different length fins, in accordance with certain configurations.
Figure 8A:
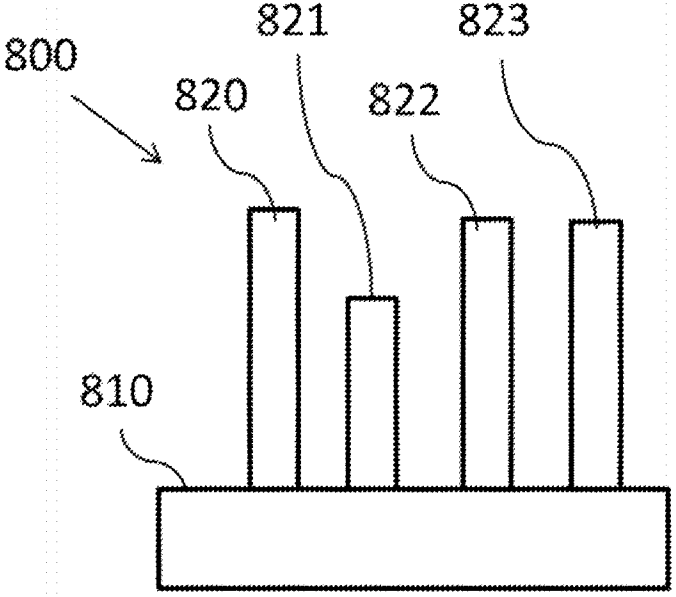

In certain instances, the length of the fins may vary. Referring to FIG. 8A, an induction device 800 is shown comprising a base 810 and fins 820-823 where at least one of the fins has a length different from another fin. For example, fin 821 is shown as having a shorter length than fins 820, 822 and 823. It may be desirable to alter the length of the fins to provide increase air flow through the spaces between the fins. For example and referring to FIG. 8B, an induction device may comprise a base 860 electrically coupled to fins 870-873 with every other fin being sized similarly, e.g., fins 870 and 872 may be sized similarly and fins 871 and 873 may be sized similarly. The exact length of any of the fins may vary from about 0.1 inches to about 10% of the freespace signal quarter-wavelength (e.g., up to about 10 inches for 30 MHz operation), more particularly, about 0.5 inches to about 4 inches. Where different length fins are present, the fin-to-fin lateral spacing between different length fins may be the same or may be different.

Figure 9:
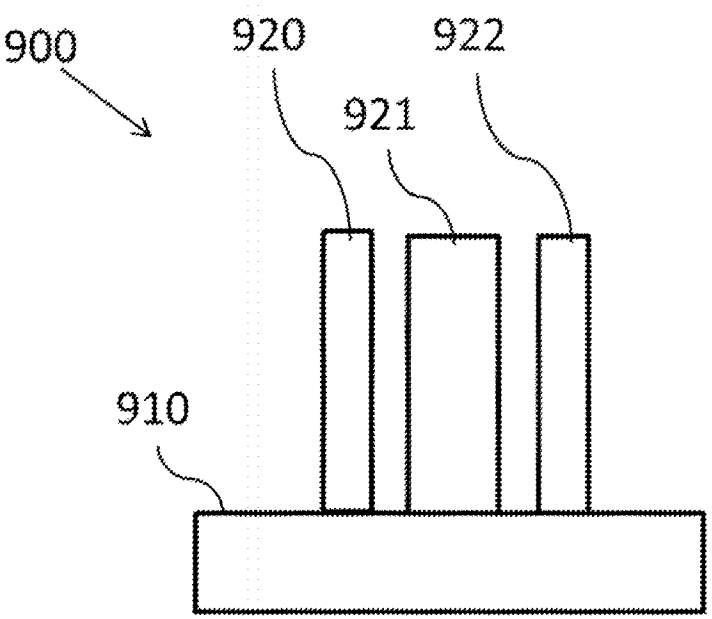
FIG. 9 shows a side view of an induction device having different width fins, in accordance with certain configurations.

In other configurations, the width of the fins may vary from fin to fin. Referring to FIG. 9, an induction device 900 is shown that comprises a base 910 electrically coupled to a fins 920-922. The fin 921 is wider than the fins 920 and 922. Depending on the position of the fins, it may be desirable to increase the fin width for fins placed downstream of the igniter, or fins that are further away from the plasma may be wider as less air flow may be needed for sufficient cooling. The exact width of any of the fins may vary from about 0.01 inches to about 5% of the freespace signal quarter-wavelength (e.g., up to about 5 inches for 30 MHz operation), more particularly, about 0.02 inches to about 1 inch. While not shown in the figures, both the length and the width of fins may be different in a single induction device. For example, an induction device may comprise fins of different lengths and widths if desired.

Figure 10:
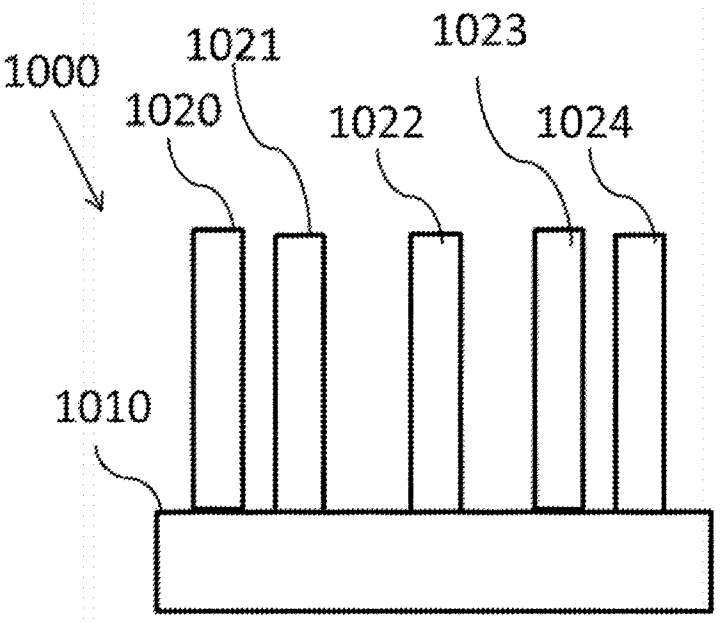
FIG. 10 shows an induction device with different fin-to-fin lateral spacing, in accordance with certain configurations.

In certain examples, the fin-to-fin lateral spacing may be variable within the induction device. For ease of illustration, one embodiment is shown in FIG. 10 where the fins all have the same length and width, but as noted herein, fins of differing lengths and widths may also be present. The induction device 1000 comprises a base 1010 and fins 1020-1024. The lateral spacing between fins 1020 and 1021 is shown as being smaller than the spacing between fins 1021 and 1022 or the spacing between fins 1023 and 1024. While the exact effect of varying fin-to-fin spacing on the magnetic field may change depending on the currents provided to the induction device, by selecting suitable spacing between fins, it may be possible to provide better temperature control to extend the lifetime of the induction device and/or any torch positioned within the induction device. In some examples, the spacing between fins may vary from about 0.01 inches to about 5 inches, more particularly, about 0.02 inches to about 1 inch.

Figure 11A:
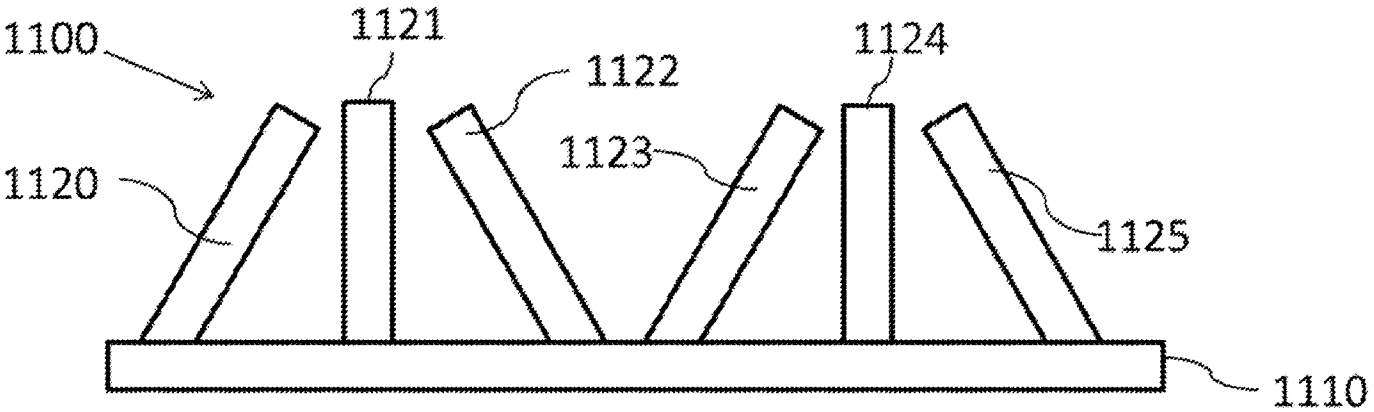
FIGS. 11A and 11B are illustrations of induction devices with fins oriented at different angles, in accordance with certain configurations.
Figure 11B:
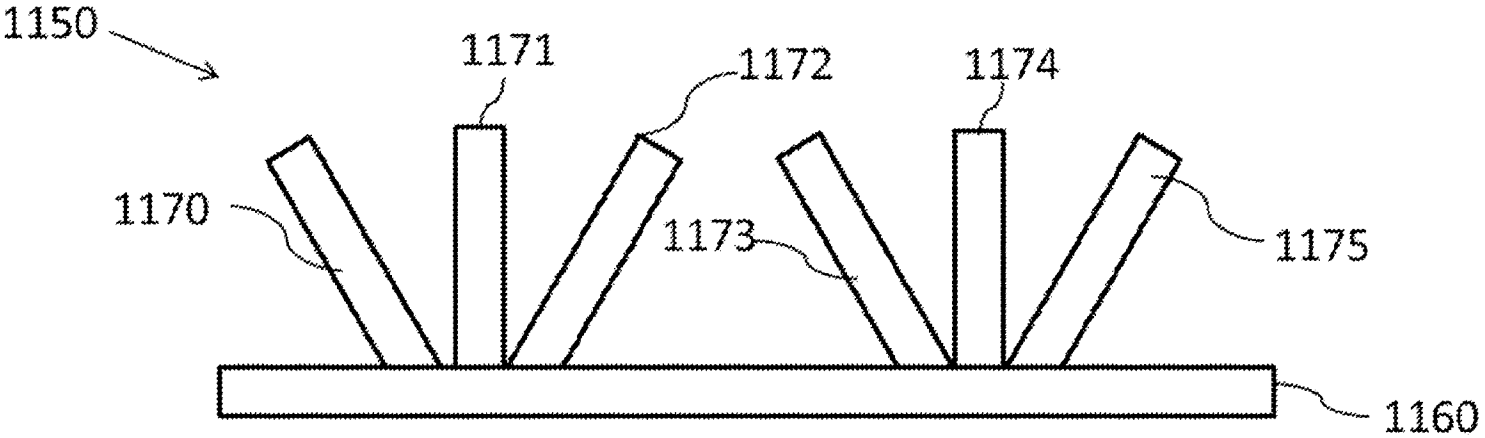

In certain embodiments, one or more fins may be angled at a different angle relative to other fins present in the induction device. Referring to FIG. 11A, one illustration of an induction device comprising differently angled fins is shown. The induction device 1100 comprises a base 1110 electrically coupled to fins 1120-1125. Fins 1120 and 1122 are angled toward fin 1121, and fins 1123, 1125 are angled toward fin 1124. As the induction device 1110 is coiled, the exact angle of the fins relative to each other can change. In another configuration (see FIG. 11B), an induction device 1150 may comprise a base 1160 and fins 1170-1175. Fins 1170 and 1172 are angled away from fin 1171, and fins 1173 and 1175 are angled away from fin 1174. Similar to the induction device 1100, as the induction device 1150 is coiled the exact angle between the various fins may change. If desired, an induction device may comprise fins 1120-1122 and fins 1170-1172, for example. Other configurations are also possible and will be recognized by the person of ordinary skill in the art, given the benefit of this disclosure.

Figure 12B:
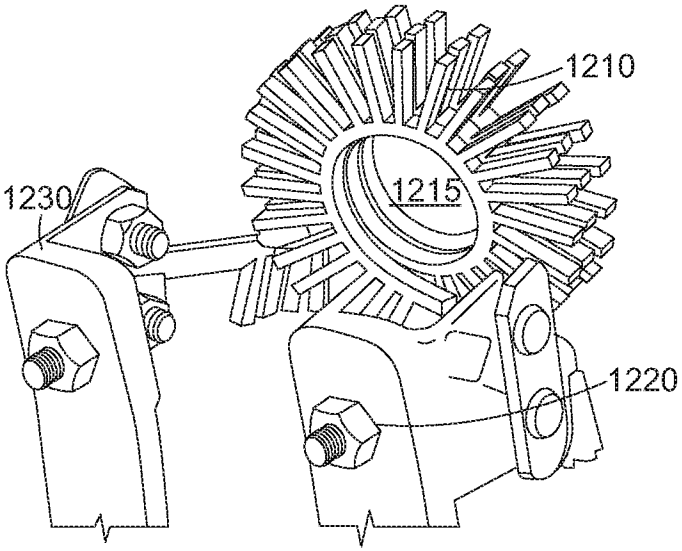
FIGS. 12A and 12B are black and white line drawings produced from photographs of an induction device that has been coiled, in accordance with certain configurations.
Figure 12A:
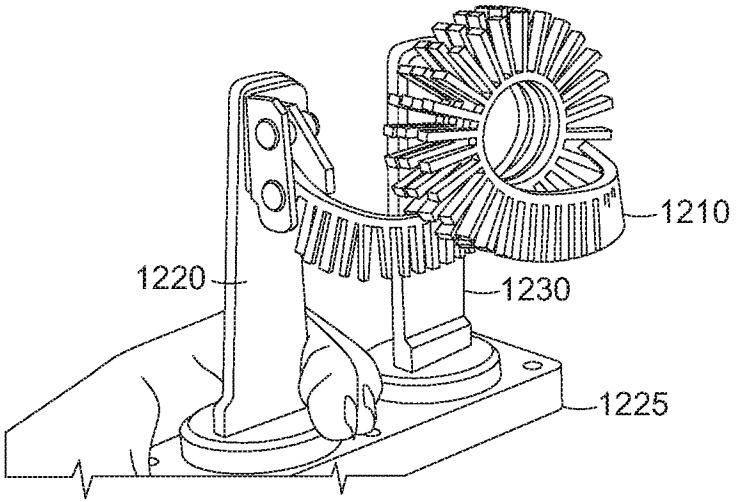

In certain embodiments, black and white line drawings produced from photographs of a coiled induction device are shown in FIGS. 12A and 12B. The induction device 1210 is electrically coupled to a mount or interface 1225 through interconnects or legs 1220, 1230. For example, one end of the induction device 1210 is electrically coupled to the leg 1220, and the other end of the induction device 1210 is electrically coupled to the leg 1230. Current of opposite polarity can be provided to each of the legs 1220, 1230 or a current may be provided to the induction device 1210 through the leg 1220 and the leg 1230 can be connected to ground, for example. In some instances, one of the legs 1220, 1230 may be omitted, and the other end of the induction device 1210 may be electrically coupled to ground. If desired, the induction device, at some point between the legs 1220 and 1230, may be electrically coupled to ground. As shown in FIG. 12B, coiling of the induction device 1210 and attachment to the legs 1220, 1230 provides an aperture 1215 that may receive a torch. The aperture 1215 is generally sized and arranged to permit insertion of the torch into the aperture 1215 without the torch surfaces touching the induction device 1210. Cooling gas may be provided to the induction device 1210 and can flow around the fins and the base of the induction device 1210 to enhance thermal transfer and keep the induction device 1210 and/or torch from degrading due to excessive temperature.

In certain embodiments, the number of turns shown in the induction device 1210 is about three. More particularly, there are about three total turns formed by coiling the base of the induction device 1210. To increase or decrease the number of turns, the overall length of the base of the induction device can be altered with increased length permitting more turns and decreased length permitting fewer turns. It may be desirable, however, to use fewer turns than possible. For example, if an induction device has a length suitable to permit about five turns, it may be desirable to coil the device to include fewer than five turns. While not wishing to be bound by any particular theory, as the number of turns increases, the length of the plasma can increase. In addition, the spacing between turns may be the same or may be different. For example, the spacing between a first turn and a second turn may differ from the spacing between a second turn and a third turn. Spacing can be controlled, for example, by positioning the fins at desired positions and/or by altering how tightly coiled the base is in the induction device or can be adjusted using one or more of the spacers, e.g., fin spacers, described herein.

In certain configurations, the fins present on the induction device generally do not reduce the inductance of the load coil because eddy current cannot flow along the gaps between the fins. This permits an increase in fin length to provide for better heat dissipation while at the same time avoiding any increase in eddy currents. Mechanical stresses can be distributed in the induction device, making it more stable when subject to heat. For example, between adjacent turns of the induction device, there can be no localized connections that are subject to higher mechanical stress, which may cause asymmetrical distortion of the induction device. While the induction device can be produced as separate components that are coupled to each other using a weld, solder, adhesive or other materials, in some examples the induction device may be fabricated using a single metal sheet, e.g., laser cut from a single sheet of material such as, for example, 125 mil thick aluminum or copper sheets. The lack of welded or soldered joints can increase the long-term reliability for improved electrical connectivity.

In certain embodiments, the induction devices described herein may be used to sustain a low flow argon plasma. For example, the induction device may permit an argon plasma gas flow of less than 15 Liters/minute, more particularly less than 14, 13, 12, 11 or 10 Liters/minute or, in certain instances, even less than 5 Liters/minute of argon plasma gas. The power provided to the induction device may be similar to that used with conventional helical induction coils, though it may be desirable to alter the electrical parameters to analyze certain species and/or when using low flow conditions.

In certain embodiments, the base of the induction device may generally be flat or small compared to the length of the fins, e.g., as shown in FIGS. 12A and 12B, to permit coiling of the induction device. In some instances, one or more joints may be present in the base at desired locations to facilitate coiling of the induction device. The joints may take many forms including, for example, ball and socket joints, hinges, or other suitable joints. The joints may be fixed in position once the base is coiled to maintain the size of the aperture formed by coiling of the induction device. In other instances, individual induction device sections may be coupled to each other to provide a desired number of turns. For example, two or more induction devices each of which is configured to provide two turns may be coupled to each other to provide an induction device with four turns. Additional induction devices may be coupled to each other to provide additional turns.

In certain examples, the exact geometry of the aperture formed by coiling of the base of the induction device can vary. As shown in FIGS. 12A and 12B, the aperture is generally circular and symmetrical. If desired, however, the aperture may be asymmetrical or may take shapes other than circular, e.g., elliptical, ovoid, square, rectangular, triangular, pentagonal, hexagonal, etc. In addition, the aperture may not be shaped the same along the length of the induction device. For example, the aperture formed by the first two turns may be circular and the aperture formed by the third turn may be elliptical or take other shapes. By altering the shape of the aperture, the magnetic field provided to the torch can be altered. In some instances, the shape of the aperture is generally selected to match the cross-sectional shape of the torch. Where the torch has a generally circular cross-sectional shape, the cross-sectional shape of some portion of the aperture formed by the induction device may be circular as well.

Figure 13B:
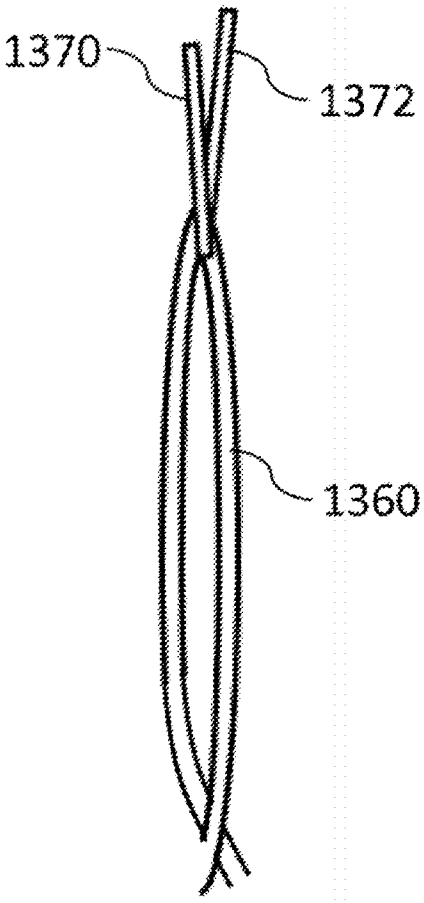
FIGS. 13A and 13B are illustrations of coiled induction devices where the fin angle differs, in accordance with certain configurations.
Figure 13A:
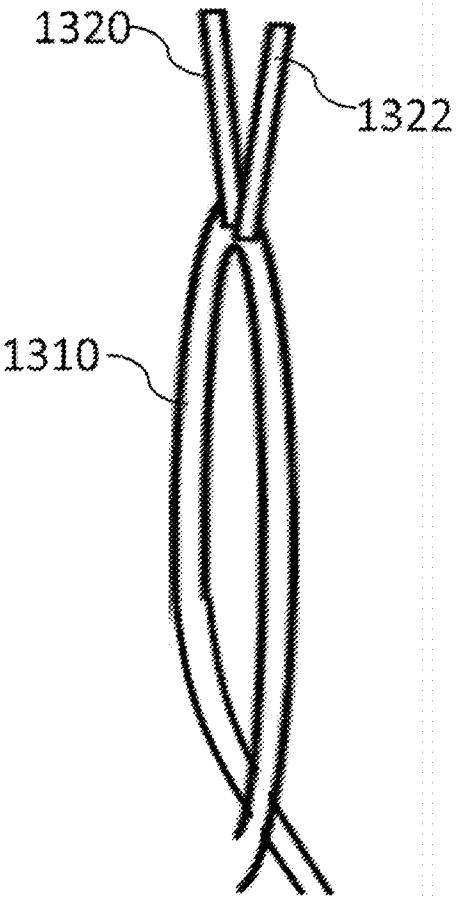

In certain configurations, when the induction device is coiled the resulting fin angle may be the same or may be different for different fins. In general, the fin angles will be different (with respect to the longitudinal axis of a torch inserted through the aperture formed by the coil) as the coiling results in different fin angles. For example, the coiling of the base may result in a slight tilting of the fins such that the fins are positioned at a non-orthogonal angle to the longitudinal axis of the torch. A side view of a single turn is shown in FIG. 13A. A fin 1322 is tilted toward the back face of a base 1310, and a fin 1320 is tilted toward the front face of the base 1310. Referring to FIG. 13B, a fin 1370 is tilted toward a front face of a base 1360, and a fin 1372 is tilted toward a back face of the base 1360. If desired, the fins may be tilted towards the same face. The illustrations shown in FIGS. 13A and 13B are provided for examples purposes only to demonstrate that one or more fins electrically coupled to the coiled base may be tilted at a different angle than another fin that is electrically coupled to the coiled base.

Figure 14A:
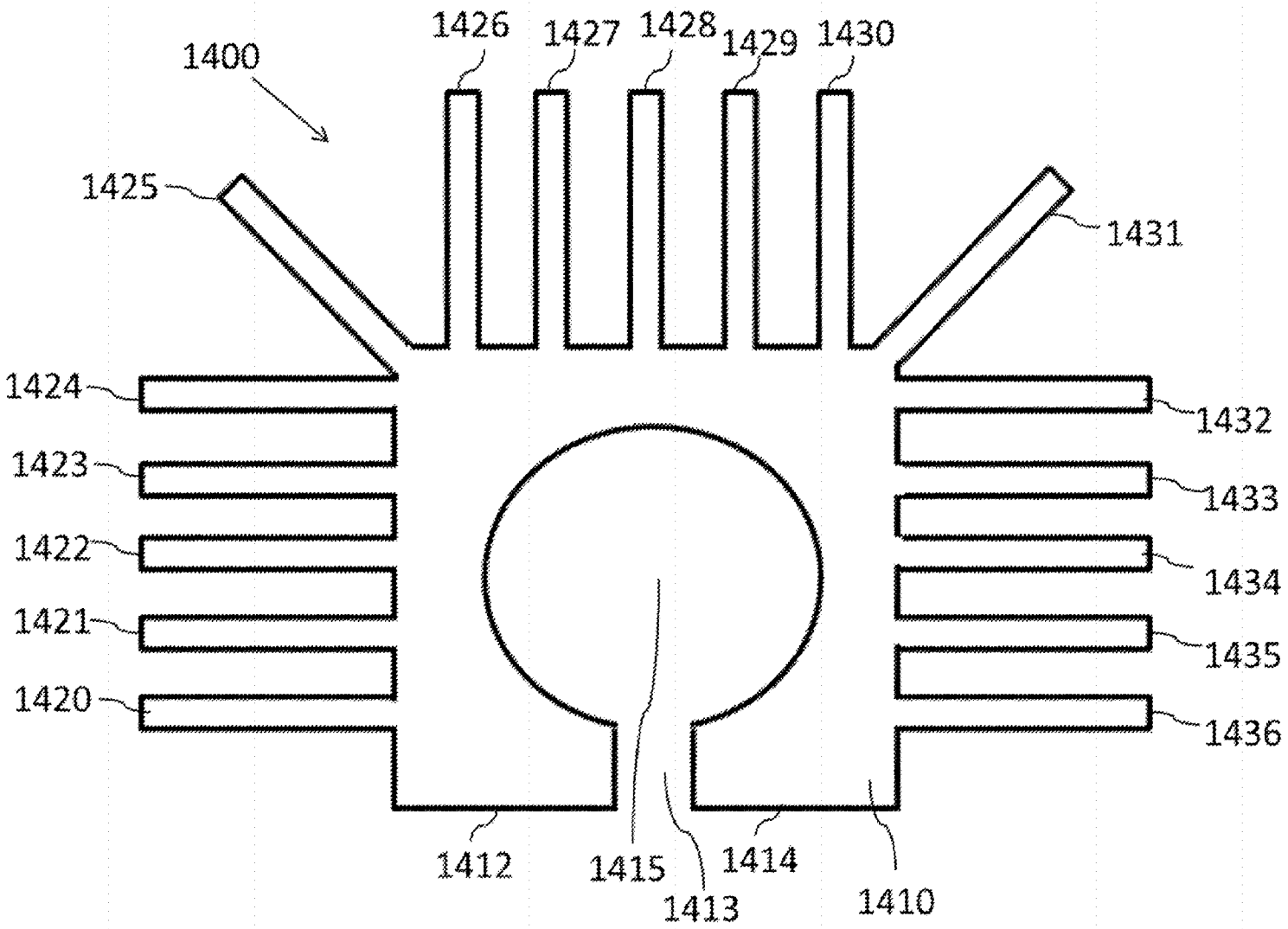
FIGS. 14A and 14B are illustrations of a plate electrode comprising a plurality of fins, in accordance with certain configurations.

In some embodiments, the base of the induction device may be sized and arranged similar to that of a plate electrode. For example and referring to FIG. 14A, an induction device 1400 is shown that comprises a base plate 1410 electrically coupled to a plurality of fins 1420-1436. An inner aperture 1415 is present and is sized and arranged to receive a torch. A slot 1413 is present and splits the sides 1412 and 1414 of the base plate 1410. Each of the sides 1412, 1414 may be electrically coupled to a RF generator or other power source. The fins 1420-1436 extend the size of the plate without increasing eddy currents that may result when larger plates are used. For example, the fins may be spaced apart a desired distance to permit a cooling gas to flow around the fins and at the same time can assist in providing a magnetic field (or electric field or both) to the torch. While the outer cross-section of the base 1410 is shown as being generally rectangular, other shapes such as circular, triangular, pentagonal, hexagonal, etc. may be present instead.

Figure 14B:
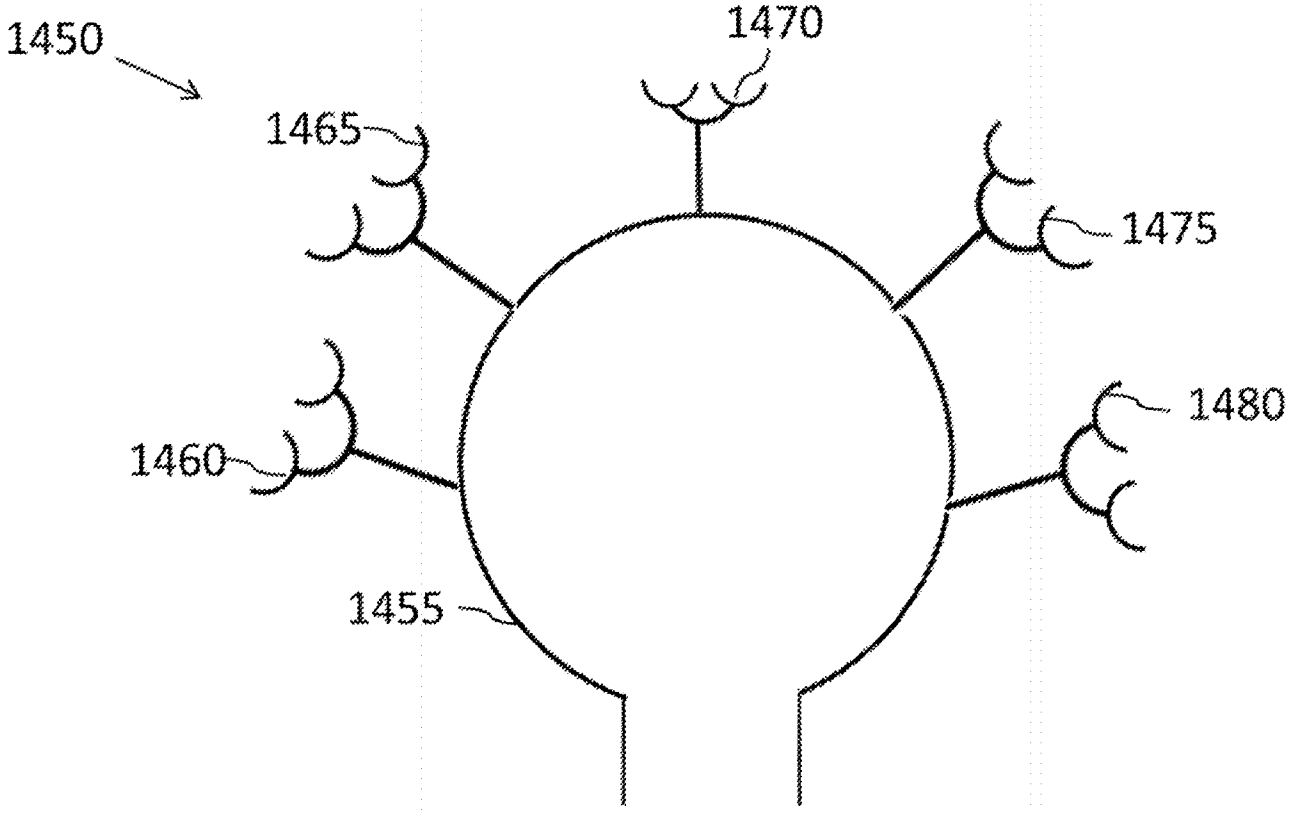

Another configuration of an electrode comprising a plurality of fins is shown in FIG. 14B. The electrode 1450 comprises a generally circular base plate 1455, and a plurality of fins such as fins 1460, 1465, 1470, 1475 and 1480 coupled to the base plate 1455. In the illustrative configuration of FIG. 14B, each of the fins 1460-1480 may comprise a plurality of generally U-shaped members coupled to each other. In some instances, the length of the arms of each U-shaped member can be the same, whereas in other instances, different u-shaped members may have different dimensions.

Figure 15B:
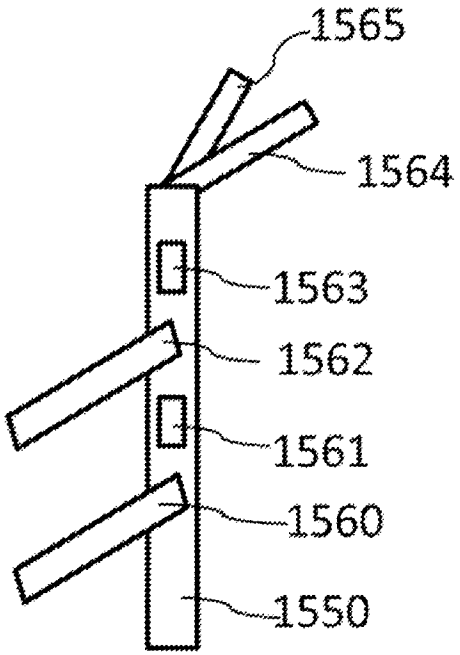
FIGS. 15A and 15B are side views of plate electrodes showing different orientations of fins, in accordance with certain configurations.
Figure 15A:
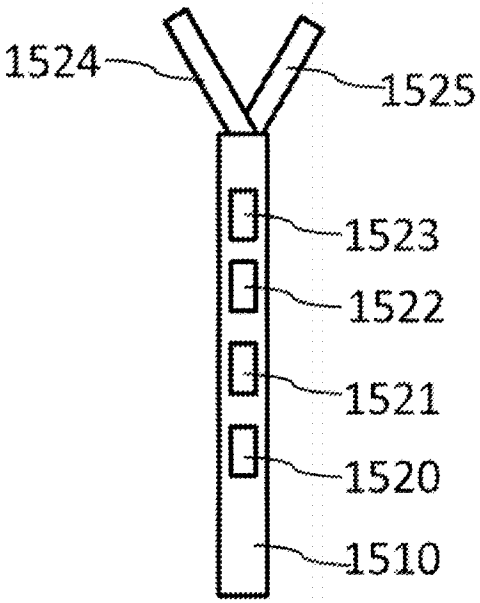

In certain configurations, the angle of fins present on base plates need not be the same. Referring to FIG. 15A, a side view of an induction device comprising a base plate electrically coupled to fins is shown. The base structure 1510 is shown as being a flat plate that is electrically coupled to fins 1520-1525. Fins 1520-1523 are shown as projecting out of the page, and fins 1524 and 1525 are angled toward the front and back, respectively, of the base plate 1510. FIG. 15B shows another configuration where the fins are positioned at different angles. A base plate 1550 is electrically coupled to fins 1560-1565. Fins 1560, 1562 are angled toward a front of the base plate 1550, fins 1564 and 1565 are angled toward the back of the base plate 1550 and fins 1561 and 1563 are angled out of the page. The different fin angles can be used to alter the air flow around the induction device and/or alter the magnetic field provided to a torch within the induction device.

Figure 16:
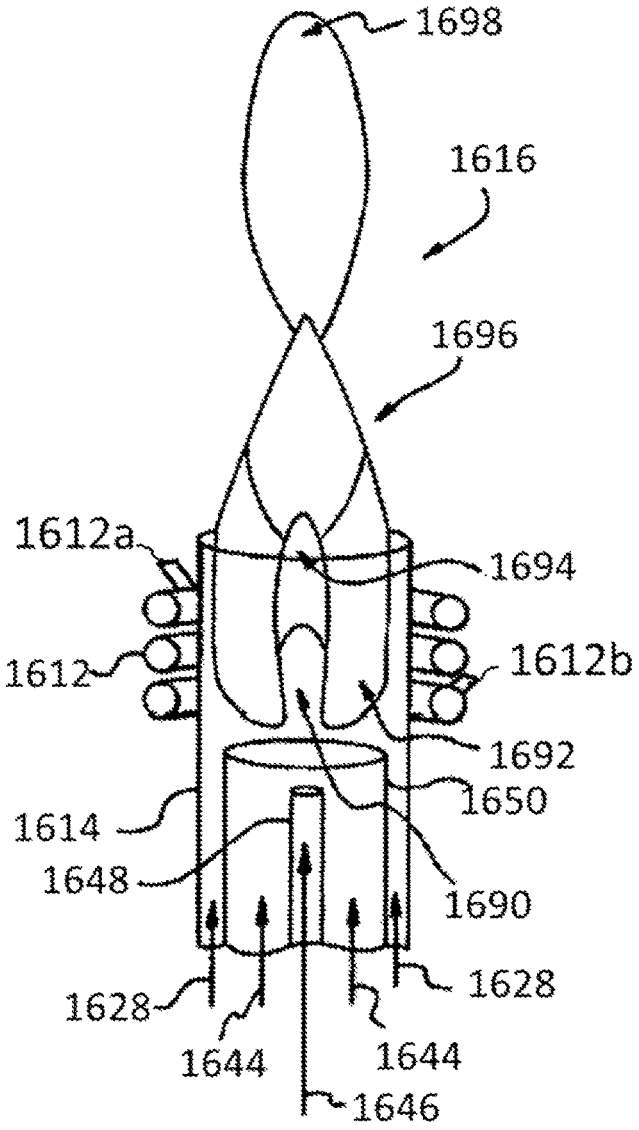
FIG. 16 is an illustration of a finned induction device surrounding a torch, in accordance with certain configurations.

In certain examples, the induction devices described herein may be used with a torch configured to sustain an inductively coupled plasma within the torch. An embodiment showing a coiled induction device comprising a plurality of radial fins is shown in FIG. 16, where the majority of the radial fins have been omitted for clarity. In some embodiments, the induction device may comprise a finned coil comprising a selected number of turns, e.g., 3-10 turns. The finned coil provides RF energy into the torch to sustain the plasma. For example, a torch 1614 and an coiled induction device 1612 comprising radial fins 1612*a*, 1612*b* is shown that would electrically couple to an RF generator. The fins 1612*a*, 1612*b* are positioned radially in reference to the longitudinal axis of the torch. The torch 1614 includes three generally concentric tubes 1614, 1650, and 1648. The innermost tube 1648 provides atomized flow 1646 of the sample into the plasma 1616. The middle tube 1650 provides auxiliary gas flow 1644 to the plasma 1616. The outermost tube 1614 provides carrier gas flow 1628 for sustaining the plasma. The carrier gas flow 1628 may be directed to the plasma 1616 in a laminar flow about the middle tube 1650. The auxiliary gas flow 1644 may be directed to the plasma 1616 within the middle tube 1650 and the sample flow 1646 may be directed to the plasma 1616 from a spray chamber (not shown) or other sample introduction device along the innermost tube 1648. RF current provided to the finned induction device 1612 from the generator may form a magnetic field within the induction device 1612 so as to confine the plasma 1616 therein. A plasma tail 1698 is shown that exits the torch 1614. In certain examples, the plasma 1616 comprises a preheating zone 1690, an induction zone 1692, an initial radiation zone 1694, an analytic zone 1696 and a plasma tail 1698. The length of any of these zones may be altered, for example, by adjusting the nature of the induction device 1612. In operation of the induction device 1612, a plasma gas may be introduced into the torch 1614 and ignited. RF power from the generator electrically coupled to the induction device 1612 may be provided to sustain the plasma 1616 during ignition. In a typical plasma, argon gas may be introduced into the torch at flow rates of about 15-20 Liters per minute, though as noted herein by using a finned induction device, the plasma gas can be reduced below 15 liters/minutes if desired. The plasma 1616 may be generated using a spark or an arc to ignite the argon gas. The toroidal magnetic field from the induction device 1612 causes argon atoms and ions to collide, which results in a superheated environment, e.g., about 5,000-10,000 K or higher, that forms the plasma 1616. While the induction device 1612 is shown in FIG. 16 as including about three turns, it will be recognized by the person of ordinary skill in the art, given the benefit of this disclosure, that fewer or more than three turns may be present in the induction device 1612.

Figure 17:
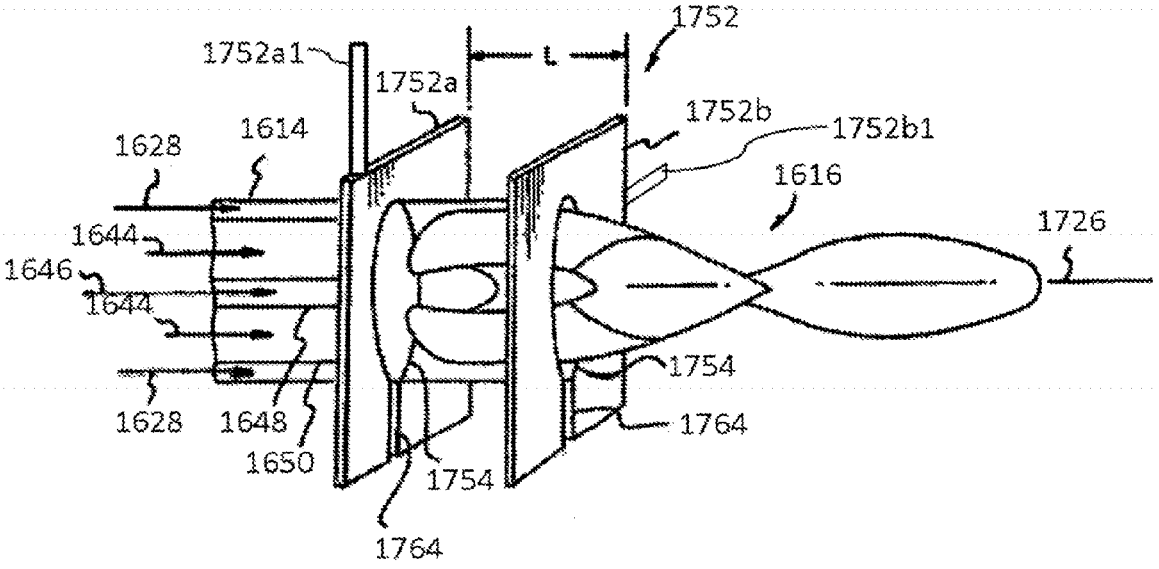
FIG. 17 is an illustration of finned plate electrodes surrounding a torch, in accordance with certain configurations.

In some embodiments, one or more plate electrodes comprising fins may be electrically coupled to a generator and used to sustain a plasma. In certain examples, the planar nature of the plate electrodes permits generation of a loop current in the torch body which is substantially perpendicular to the longitudinal axis of the torch body. The fins may provide for increased surface area to improve heat dissipation and permit the plates to have larger dimensions than where fins are not present. The plate electrodes may be spaced symmetric from each other where more than two plate electrodes are present, or the plates electrodes may be asymmetrically spaced from each other, if desired. An illustration of two plate electrodes each with radial fins is shown in FIG. 17. While a single radial fin is shown on electrodes 1752*a* and 1752*b*, a plurality of fins, e.g., similar to that shown in FIG. 14, may be present on each electrode 1752*a*, 1752*b*. The electrodes 1752*a*, 1752*b* can be electrically coupled to a generator to permit operation of the plate electrodes. The induction device 1752 comprises two substantially parallel plates 1752*a*, 1752*b* positioned at a distance 'L' from one another. Each of the parallel plates 1752*a*, 1752*b* includes an aperture 1754 through which the torch 1614 may be positioned such that the torch 1614, the innermost tube 1648, the middle tube 1650 and the aperture 1754 are aligned along a longitudinal axis 1726, which is generally parallel to the longitudinal axis of the torch 1614. The exact dimensions and shapes of the aperture may vary and may be any suitable dimensions and shapes that can accept a torch. For example, the aperture 1754 may be generally circular, may be square or rectangular shaped or may have other shapes, e.g., may be triangular, oval, ovoid, or have other suitable geometries. In certain examples, the aperture may be sized such that it is about 0-50% or typically about 3% larger than the outer diameter of the torch 1614, whereas in other examples, the torch 1614 may contact the plates 1752*a*, 1752*b*, e.g., some portion of the torch may contact a surface of a plate, without any substantial operational problems. The aperture 1754 of the induction device 1752 may also include a slot 1764 such that the aperture 1754 is in communication with its surroundings. Electrode 1752*a* comprises a radial fin 1752*a*1, and electrode 1752*b* comprises a radial fin 1752*b*1, though as noted above a plurality of fins may be present on one or both of the electrodes 1752*a*, 1752*b*. The fins 1752*a*1, 1752*b*1 are positioned radially with respect to the longitudinal axis 1726. In use of the finned plates 1752*a*, 1752*b*, an RF generator is electrically coupled to the plates 1752*a*, 1752*b*. RF current is supplied to the plates 1752*a*, 1752*b* to provide a planar loop current, which generates a toroidal magnetic field through the aperture 1754. Though two plate electrodes 1752*a*, 1752*b* are shown in FIG. 17, a single finned plate electrode can be used, three finned plate electrodes can be used or more than three finned plate electrodes can be used. In addition, one plate electrode may be finned and another plate electrode may have no fins. For example, plate electrodes upstream near an igniter may not have fins, and plate electrodes downstream may be finned or vice versa. In some instances, one or more finless plate electrodes is sandwiched between two finned plate electrodes. In other configurations, one finned plate electrode is sandwiched between two finless plate electrodes. Other configurations are possible and will be recognized by the person of ordinary skill in the art, given the benefit of this disclosure.

Figure 18:
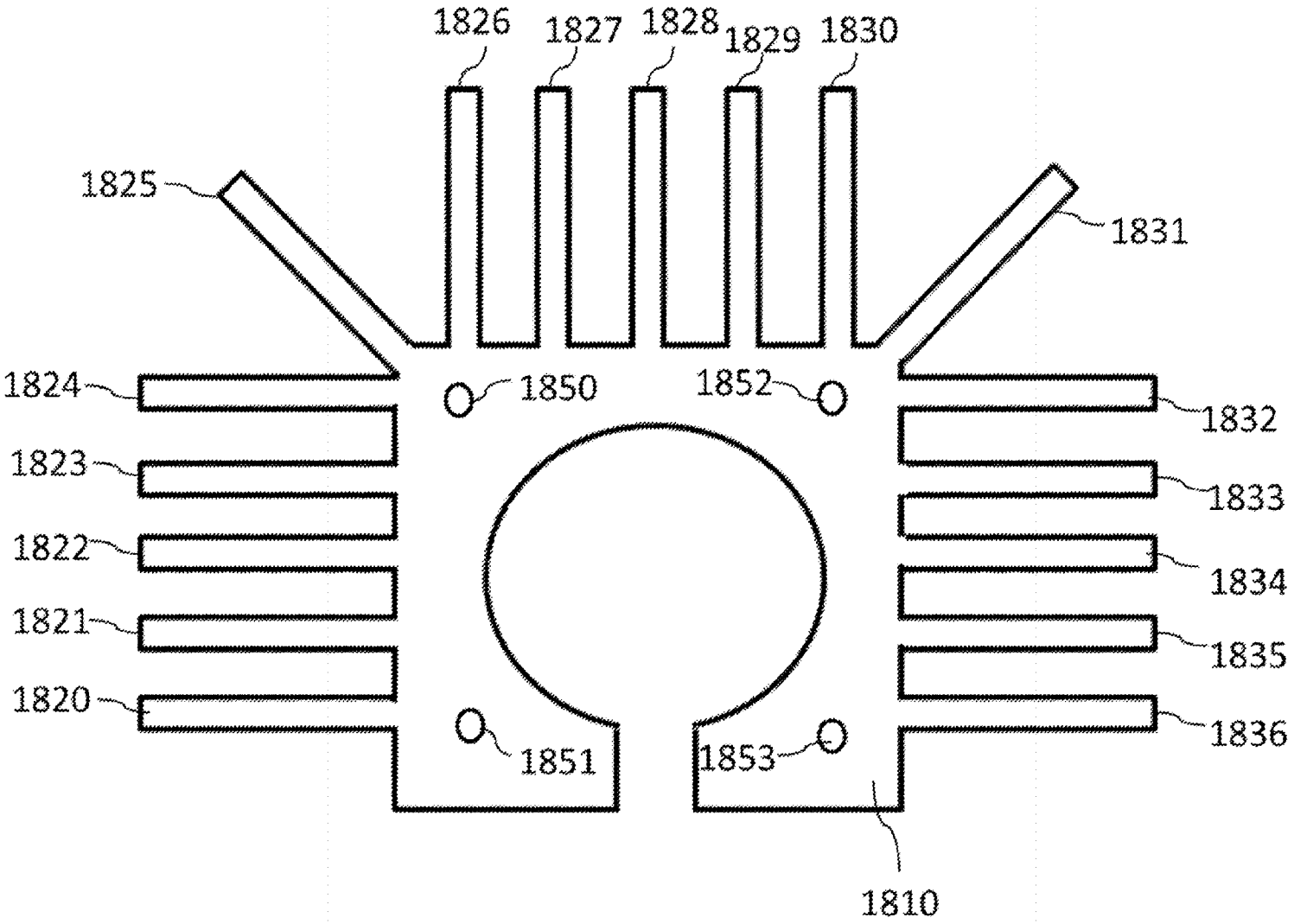
FIG. 18 is an illustration of a finned plate electrode comprising a cooling aperture in the base, in accordance with certain examples.

In certain instances where plate electrodes are used, the plate electrode may comprise one or more apertures or through-holes in addition to the fins. For example and referring to FIG. 18, a plate electrode is shown comprising a generally flat base 1810 and a plurality of radial fins 1820-1836. Apertures or holes 1850-1853 are present in the base 1810 to permit air to pass through the base 1810 and cool the electrode. The size of the apertures 1850-1853 may vary but are desirably small enough so that the field provided by the electrode is not disrupted to a substantial degree. The number of apertures in the base 1810 may vary from about one to about twenty, more particularly about two to about ten or other desired numbers of apertures may be present. The apertures can be positioned close to the edges of the base 1810 or anywhere else along the surface of the base 1810. While apertures in a plate electrode are shown in FIG. 18, similar apertures can be present in the base of an induction device designed to form an induction coil, e.g., such as the induction device shown in FIGS. 12A and 12B. If desired, one or all of the fins may be omitted or replaced with the apertures such that a finless induction device with integral apertures can be used to sustain a plasma.

Figure 19:
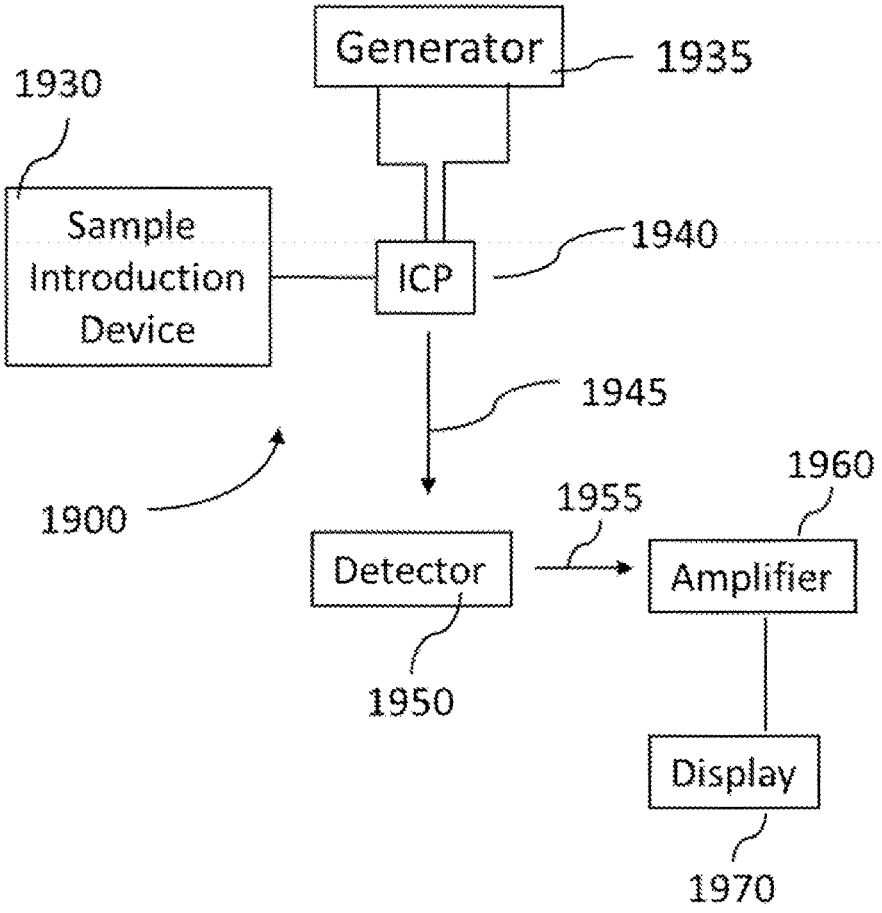
FIG. 19 is a block diagram of an optical emission spectrometer, in accordance with certain configurations.

In certain examples, the induction devices described herein can be used to sustain an inductively coupled plasma (ICP) that is present in an optical emission system (OES). Illustrative components of an OES are shown in FIG. 19. The device 1900 includes a sample introduction system 1930 fluidically coupled to a components used to provide an ICP 1940. A finned induction device can be electrically coupled to a generator 1935 and may be used to sustain the ICP 1940 in a torch. The generator 1935 may be an RF generator such as, for example, a hybrid RF generator as described in the commonly owned application incorporated herein by reference. The ICP 1940 is fluidically (or optically or both) coupled to a detector 1950. The sample introduction device 1930 may vary depending on the nature of the sample. In certain examples, the sample introduction device 1930 may be a nebulizer that is configured to aerosolize liquid sample for introduction into the ICP 1940. In other examples, the sample introduction device 1930 may be configured to directly inject sample into the ICP 1940. Other suitable devices and methods for introducing samples will be readily selected by the person of ordinary skill in the art, given the benefit of this disclosure. The detector 1950 can take numerous forms and may be any suitable device that may detect optical emissions, such as optical emission 1955. For example, the detector 1950 may include suitable optics, such as lenses, mirrors, prisms, windows, band-pass filters, etc. The detector 1950 may also include gratings, such as echelle gratings, to provide a multi-channel OES device. Gratings such as echelle gratings may allow for simultaneous detection of multiple emission wavelengths. The gratings may be positioned within a monochromator or other suitable device for selection of one or more particular wavelengths to monitor. In certain examples, the detector 1950 may include a charge coupled device (CCD). In other examples, the OES device may be configured to implement Fourier transforms to provide simultaneous detection of multiple emission wavelengths. The detector 1950 can be configured to monitor emission wavelengths over a large wavelength range including, but not limited to, ultraviolet, visible, near and far infrared, etc. The OES device 1900 may further include suitable electronics such as a microprocessor and/or computer and suitable circuitry to provide a desired signal and/or for data acquisition. Suitable additional devices and circuitry are known in the art and may be found, for example, on commercially available OES devices such as Optima 2100DV series, Optima 5000 DV series and Optima 7000 series OES devices commercially available from PerkinElmer Health Sciences, Inc. (Waltham, Mass.). The optional amplifier 1960 may be operative to increase a signal 1955, e.g., amplify the signal from detected photons, and can provide the signal to a display 1970, which may be a readout, computer, etc. In examples where the signal 1955 is sufficiently large for display or detection, the amplifier 1960 may be omitted. In certain examples, the amplifier 1960 is a photomultiplier tube configured to receive signals from the detector 1950. Other suitable devices for amplifying signals, however, will be selected by the person of ordinary skill in the art, given the benefit of this disclosure. It will also be within the ability of the person of ordinary skill in the art, given the benefit of this disclosure, to retrofit existing OES devices with the induction devices described herein and to design new OES devices using the induction devices disclosed herein. The OES device 1900 may further include autosamplers, such as AS90 and AS93 autosamplers commercially available from PerkinElmer Health Sciences or similar devices available from other suppliers.

Figure 20:
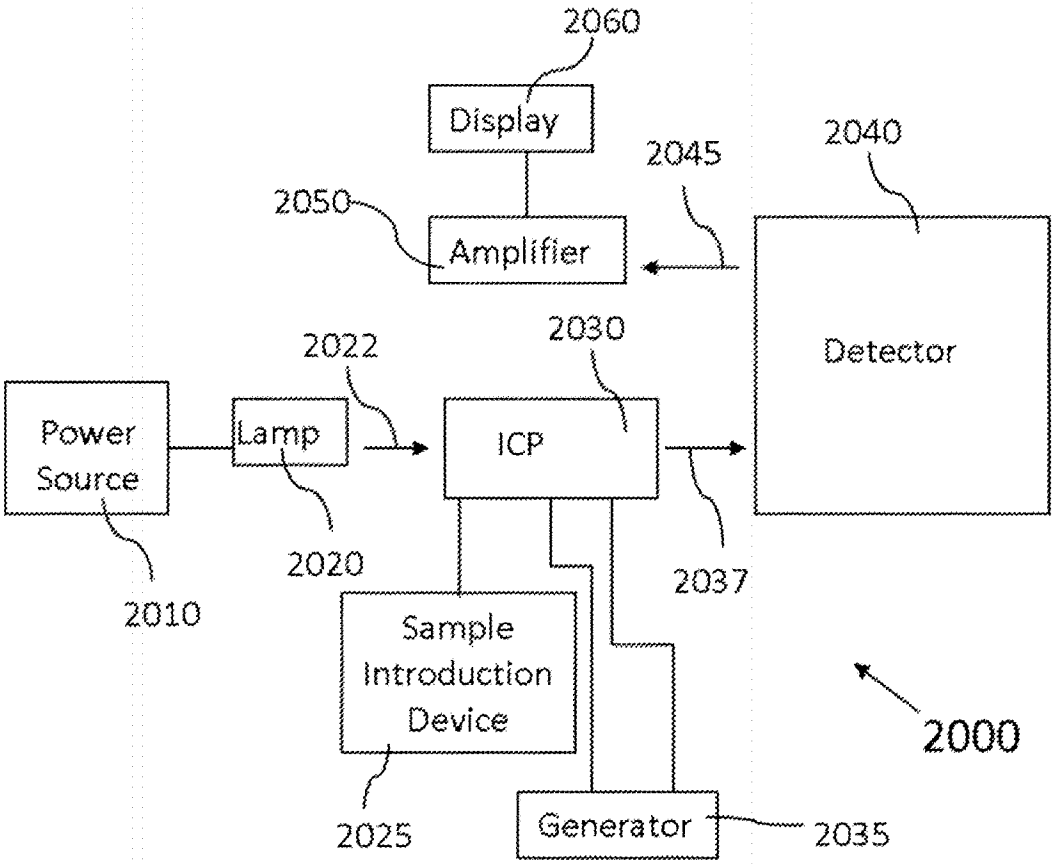
FIG. 20 is a block diagram of a single beam atomic absorption spectrometer, in accordance with certain configurations.

In certain embodiments, the induction devices described herein can be used in an instrument designed for absorption spectroscopy (AS). Atoms and ions may absorb certain wavelengths of light to provide energy for a transition from a lower energy level to a higher energy level. An atom or ion may contain multiple resonance lines resulting from transition from a ground state to a higher energy level. The energy needed to promote such transitions may be supplied using numerous sources, e.g., heat, flames, plasmas, arc, sparks, cathode ray lamps, lasers, etc., as discussed further below. In some examples, the induction devices described herein can be used to sustain an ICP to provide the energy or light that is absorbed by the atoms or ions. In certain examples, a single beam AS device is shown in FIG. 20. The single beam AS device 2000 includes a power source 2010, a lamp 2020, a sample introduction device 2025, an ICP device 2030 electrically coupled to a generator 2035, a detector 2040, an optional amplifier 2050 and a display 2060. The power source 2010 may be configured to supply power to the lamp 2020, which provides one or more wavelengths of light 2022 for absorption by atoms and ions. If desired, the power source 2010 may also be electrically coupled to the generator 2035. Suitable lamps include, but are not limited to mercury lamps, cathode ray lamps, lasers, etc. The lamp may be pulsed using suitable choppers or pulsed power supplies, or in examples where a laser is implemented, the laser may be pulsed with a selected frequency, e.g. 5, 10, or 20 times/second. The exact configuration of the lamp 2020 may vary. For example, the lamp 2020 may provide light axially along the ICP 2030 or may provide light radially along the ICP device 2030. The example shown in FIG. 20 is configured for axial supply of light from the lamp 2020. There can be signal-to-noise advantages using axial viewing of signals. The ICP 2030 may be sustained using any of the induction devices described herein, e.g., finned induction devices, or other suitable induction devices and torches that may be readily selected or designed by the person of ordinary skill in the art, given the benefit of this disclosure. As sample is atomized and/or ionized in the ICP 2030, the incident light 2022 from the lamp 2020 may excite atoms. That is, some percentage of the light 2022 that is supplied by the lamp 2020 may be absorbed by the atoms and ions in the ICP 2030. The remaining percentage of the light 2037 may be transmitted to the detector 2040. The detector 2040 may provide one or more suitable wavelengths using, for example, prisms, lenses, gratings and other suitable devices such as those discussed above in reference to the OES devices, for example. The signal may be provided to the optional amplifier 2050 for increasing the signal provided to the display 2060. To account for the amount of absorption by sample in the ICP 2030, a blank, such as water, may be introduced prior to sample introduction to provide a 100% transmittance reference value. The amount of light transmitted once sample is introduced into the ICP or exits from the ICP may be measured, and the amount of light transmitted with sample may be divided by the reference value to obtain the transmittance. The negative $\log_{10}$ of the transmittance is equal to the absorbance. The AS device 2000 may further include suitable electronics such as a microprocessor and/or computer and suitable circuitry to provide a desired signal and/or for data acquisition. Suitable additional devices and circuitry may be found, for example, on commercially available AS devices such as AAnalyst series spectrometers commercially available from PerkinElmer Health Sciences. It will also be within the ability of the person of ordinary skill in the art, given the benefit of this disclosure, to retrofit existing AS devices with the induction devices disclosed here and to design new AS devices using the induction devices disclosed herein. The AS devices may further include autosamplers known in the art, such as AS-90A, AS-90plus and AS-93plus autosamplers commercially available from PerkinElmer Health Sciences.

Figure 21:
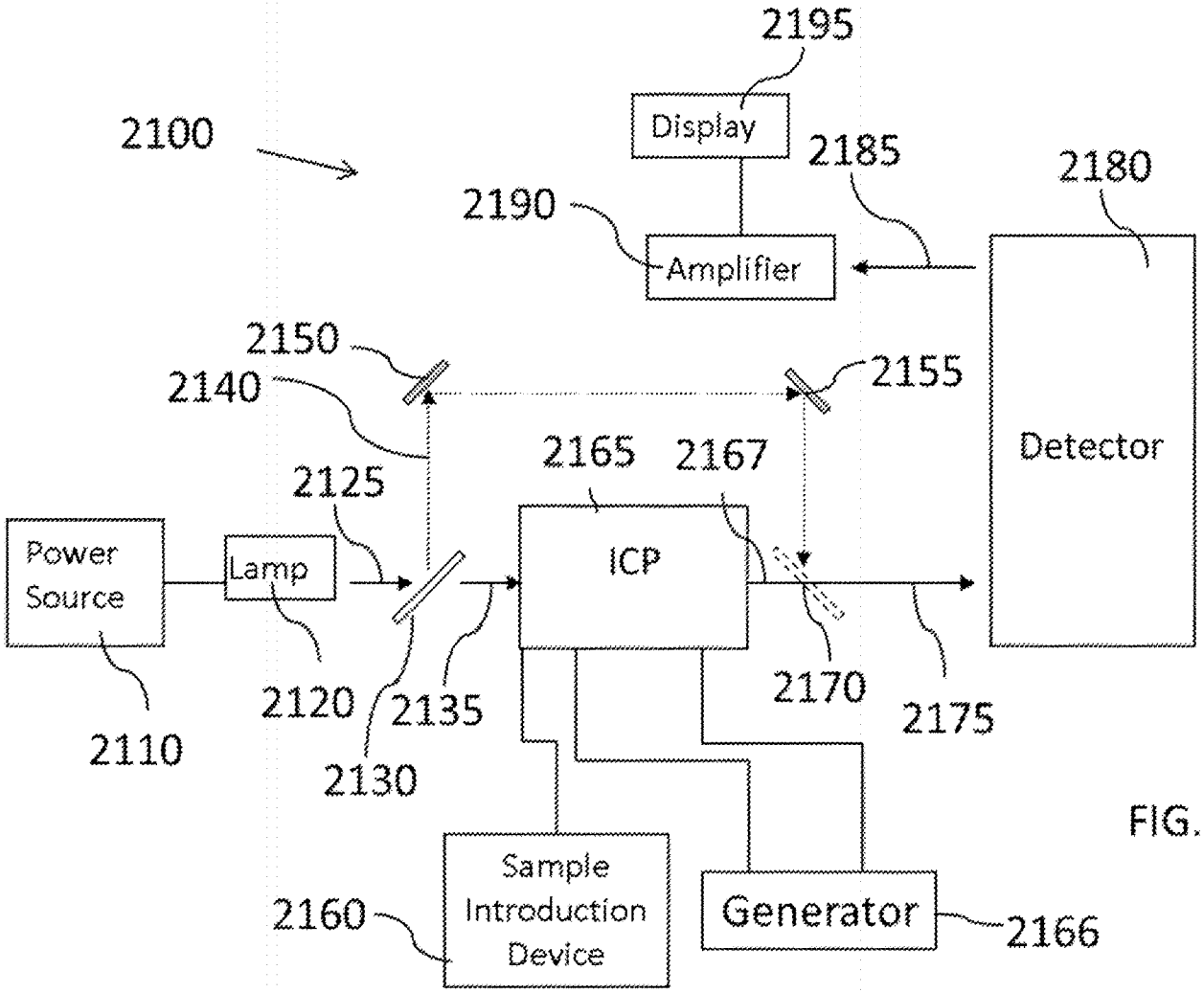
FIG. 21 is a block diagram of a dual beam atomic absorption spectrometer, in accordance with certain configurations.

In certain embodiments and referring to FIG. 21, the induction devices described herein can be used in a dual beam AS device 2100 that includes a power source 2110, a lamp 2120, a ICP 2165, a generator 2166 electrically coupled to an induction device of the ICP 2165, a detector 2180, an optional amplifier 2190 and a display 2195. The power source 2110 may be configured to supply power to the lamp 2120, which provides one or more wavelengths of light 2125 for absorption by atoms and ions. Suitable lamps include, but are not limited to, mercury lamps, cathode ray lamps, lasers, etc. The lamp may be pulsed using suitable choppers or pulsed power supplies, or in examples where a laser is implemented, the laser may be pulsed with a selected frequency, e.g. 5, 10 or 20 times/second. The configuration of the lamp 2120 may vary. For example, the lamp 2120 may provide light axially along the ICP 2165 or may provide light radially along the ICP 2165. The example shown in FIG. 21 is configured for axial supply of light from the lamp 2120. As discussed above, there may be signal-to-noise advantages using axial viewing of signals. The ICP 2165 may be sustained using a generator and any of the induction devices described herein or other similar induction devices that may be readily selected or designed by the person of ordinary skill in the art, given the benefit of this disclosure. As sample is atomized and/or ionized in the ICP 2165, the incident light 2125 from the lamp 2120 may excite atoms. That is, some percentage of the light 2125 that is supplied by the lamp 2120 may be absorbed by the atoms and ions in the ICP 2165. The remaining percentage of the light 2167 is transmitted to the detector 2180. In examples using dual beams, the incident light 2125 may be split using a beam splitter 2130 such that some percentage of light, e.g., about 10% to about 90%, may be transmitted as a light beam 2135 to the ICP 2165 and the remaining percentage of the light may be transmitted as a light beam 2140 to mirrors or lenses 2150 and 2155. The light beams may be recombined using a combiner 2170, such as a half-silvered mirror, and a combined signal 2175 may be provided to the detection device 2180. The ratio between a reference value and the value for the sample may then be determined to calculate the absorbance of the sample. The detection device 2180 may provide one or more suitable wavelengths using, for example, prisms, lenses, gratings and other suitable devices known in the art, such as those discussed above in reference to the OES devices, for example. Signal 2185 may be provided to the optional amplifier 2190 for increasing the signal to provide to the display 2195. The AS device 2100 may further include suitable electronics known in the art, such as a microprocessor and/or computer and suitable circuitry to provide a desired signal and/or for data acquisition. Suitable additional devices and circuitry may be found, for example, on commercially available AS devices such as AAnalyst series spectrometers commercially available from PerkinElmer Health Sciences, Inc. It will be within the ability of the person of ordinary skill in the art, given the benefit of this disclosure, to retrofit existing dual beam AS devices with the induction devices disclosed here and to design new dual beam AS devices using the induction devices disclosed herein. The AS devices may further include autosamplers known in the art, such as AS-90A, AS-90plus and AS-93plus autosamplers commercially available from PerkinElmer Health Sciences, Inc.

Figure 22:
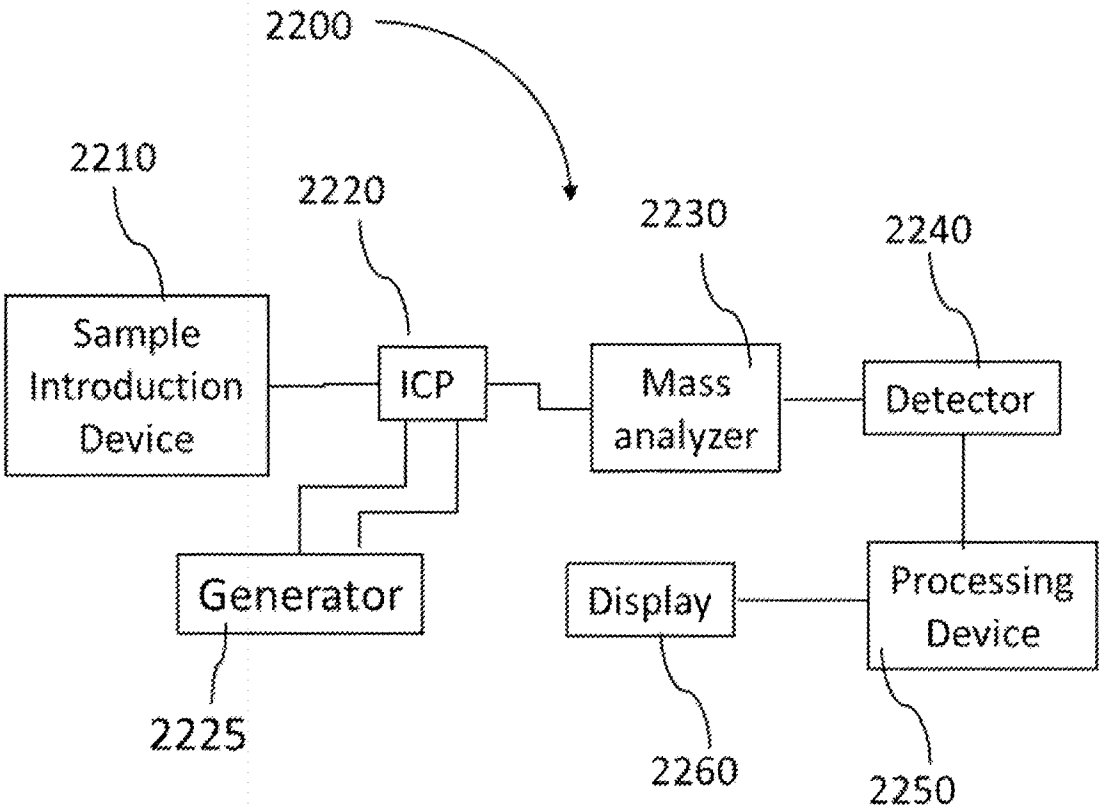
FIG. 22 is a block diagram of a mass spectrometer, in accordance with certain configurations.

In certain embodiments, the generators described herein can be used in a mass spectrometer (MS). An illustrative MS device is shown in FIG. 22. The MS device 2200 includes a sample introduction device 2210, an ionization device 2220 (labeled as ICP) electrically coupled to a generator 2225, a mass analyzer 2230, a detection device 2240, a processing device 2250 and a display 2260. The sample introduction device 2210, ionization device 2220, the mass analyzer 2230 and the detection device 2240 may be operated at reduced pressures using one or more vacuum pumps. In certain examples, however, only the mass analyzer 2230 and the detection device 2240 may be operated at reduced pressures. The sample introduction device 2210 may include an inlet system configured to provide sample to the ionization device 2220. The inlet system may include one or more batch inlets, direct probe inlets and/or chromatographic inlets. The sample introduction device 2210 may be an injector, a nebulizer or other suitable devices that may deliver solid, liquid or gaseous samples to the ionization device 2220. The ionization device 2220 may be an inductively coupled plasma generated and/or sustained using the generator 2225, e.g., using a finned induction device electrically coupled to a hybrid RF generator or conventional generator. If desired, the ionization device can be coupled to another ionization device, e.g., another device which can atomize and/or ionize a sample including, for example, plasma (inductively coupled plasmas, capacitively coupled plasmas, microwave-induced plasmas, etc.), arcs, sparks, drift ion devices, devices that can ionize a sample using gas-phase ionization (electron ionization, chemical ionization, desorption chemical ionization, negative-ion chemical ionization), field desorption devices, field ionization devices, fast atom bombardment devices, secondary ion mass spectrometry devices, electrospray ionization devices, probe electrospray ionization devices, sonic spray ionization devices, atmospheric pressure chemical ionization devices, atmospheric pressure photoionization devices, atmospheric pressure laser ionization devices, matrix assisted laser desorption ionization devices, aerosol laser desorption ionization devices, surface-enhanced laser desorption ionization devices, glow discharges, resonant ionization, thermal ionization, thermospray ionization, radioactive ionization, ion-attachment ionization, liquid metal ion devices, laser ablation electrospray ionization, or combinations of any two or more of these illustrative ionization devices. The mass analyzer 2230 may take numerous forms depending generally on the sample nature, desired resolution, etc., and exemplary mass analyzers can include one or more collision cells, reaction cells or other components as desired. The detection device 2240 may be any suitable detection device that may be used with existing mass spectrometers, e.g., electron multipliers, Faraday cups, coated photographic plates, scintillation detectors, etc., and other suitable devices that will be selected by the person of ordinary skill in the art, given the benefit of this disclosure. The processing device 2250 typically includes a microprocessor and/or computer and suitable software for analysis of samples introduced into MS device 2200. One or more databases may be accessed by the processing device 2250 for determination of the chemical identity of species introduced into MS device 2200. Other suitable additional devices known in the art may also be used with the MS device 2200 including, but not limited to, autosamplers, such as AS-90plus and AS-93plus autosamplers commercially available from PerkinElmer Health Sciences, Inc.

In certain embodiments, the mass analyzer 2230 of the MS device 2200 may take numerous forms depending on the desired resolution and the nature of the introduced sample. In certain examples, the mass analyzer is a scanning mass analyzer, a magnetic sector analyzer (e.g., for use in single and double-focusing MS devices), a quadrupole mass analyzer, an ion trap analyzer (e.g., cyclotrons, quadrupole ions traps), time-of-flight analyzers (e.g., matrix-assisted laser desorbed ionization time of flight analyzers), and other suitable mass analyzers that may separate species with different mass-to-charge ratio. In some examples, the MS devices disclosed herein may be hyphenated with one or more other analytical techniques. For example, MS devices may be hyphenated with devices for performing liquid chromatography, gas chromatography, capillary electrophoresis, and other suitable separation techniques. When coupling an MS device with a gas chromatograph, it may be desirable to include a suitable interface, e.g., traps, jet separators, etc., to introduce sample into the MS device from the gas chromatograph. When coupling an MS device to a liquid chromatograph, it may also be desirable to include a suitable interface to account for the differences in volume used in liquid chromatography and mass spectroscopy. For example, split interfaces may be used so that only a small amount of sample exiting the liquid chromatograph may be introduced into the MS device. Sample exiting from the liquid chromatograph may also be deposited in suitable wires, cups or chambers for transport to the ionization devices of the MS device. In certain examples, the liquid chromatograph may include a thermospray configured to vaporize and aerosolize sample as it passes through a heated capillary tube. Other suitable devices for introducing liquid samples from a liquid chromatograph into a MS device will be readily selected by the person of ordinary skill in the art, given the benefit of this disclosure. In certain examples, MS devices can be hyphenated with each other for tandem mass spectroscopy analyses.

In certain embodiments, the systems and devices described herein may include additional components as desired. For example, it may be desirable to include a photosensor in an optical path of the plasma so the system can detect when the plasma has been ignited.

In some examples, the induction devices described herein can be used in non-instrumental applications including, but not limited to, material deposition devices, vapor deposition devices, ion implantation devices, welding torches, molecular beam epitaxy devices or other devices or systems that use an atomization and/or ionization source to provide a desired output, e.g., ions, atoms or heat, may be used with the generators described herein. Such systems can include similar induction devices as described herein, nozzles, assist gases and other components to facilitate deposition of species into a surface. In addition, the induction devices described herein can be used in chemical reactors to promote formation of certain species at high temperature. For example, radioactive waste can be processed in a reaction chamber using devices including the induction devices described herein.

Figure 23B:
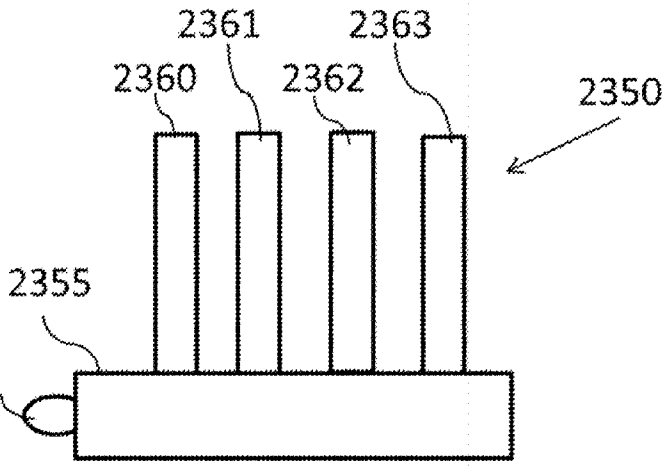
FIGS. 23A-23C show various induction devices that can be coupled to each other, in accordance with certain examples.
Figure 23A:
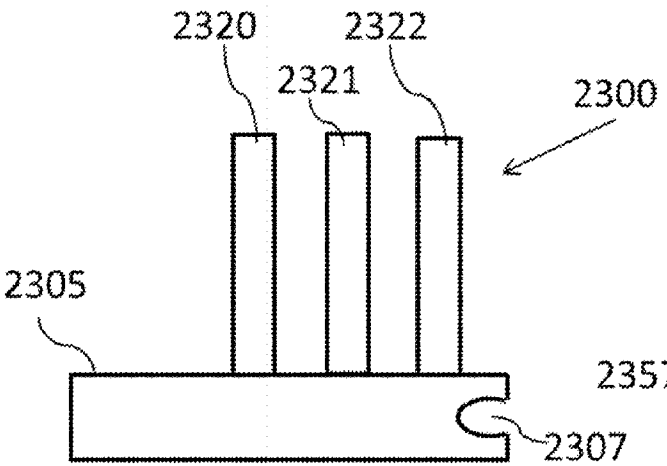
Figure 23C:
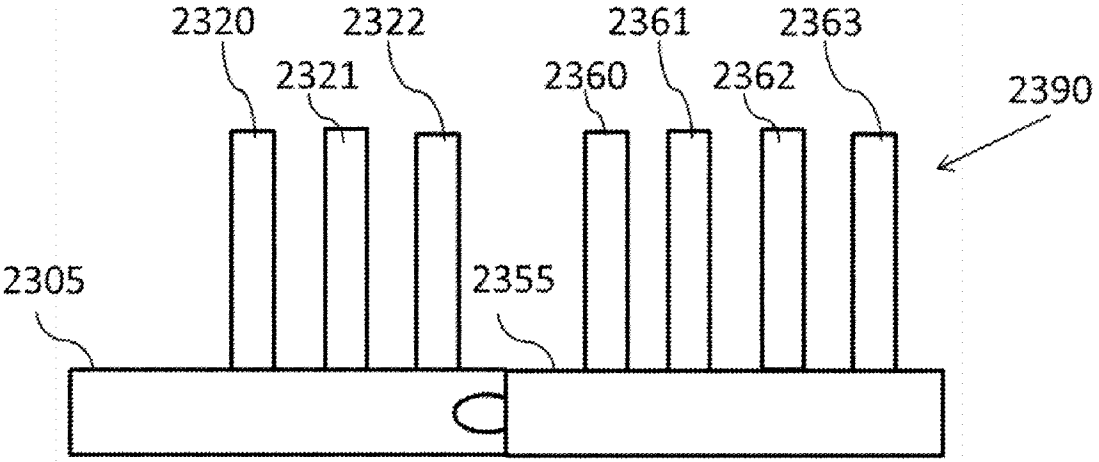

In certain examples, the induction devices described herein may be used in kit form and may include two or more individual induction devices which can be coupled to each other to provide a single induction device with a desired number of turns. Referring to FIG. 23A, a first induction device 2300 comprises a base 2305 and fins 2320-2322. A second induction device 2350 comprises a base 2355 and fins 2360-2363 (see FIG. 23B). The induction devices 2300, 2350 may be packaged together in a kit. While the number of fins of the induction devices 2300, 2350 are shown as being different, they may be the same if desired. The induction device 2300 may include a coupler 2307 in the base 2305 and is configured to receive a coupler 2357 on the base 2355. The two couplers 2307, 2357 can be coupled to each other (see FIG. 23C) to provide an induction device 2390 that comprise the components from both of the induction devices 2305 and 2355. In some embodiments, a plurality of individual induction devices may be coupled to each other to provide an induction device with a desired length and/or a desired number of fins. Different induction devices may have different length fins, different angled fins, different width fins or different fin-to-fin spacing to permit a user to assemble a functional induction device of a desired configuration. One or more of the fins may comprise through-holes or apertures as described herein. In some configurations, the couplers of the induction devices can be configured to assist in bending or coiling of the base structure to provide an inner aperture of a desired size and/or shape. For example, the couplers may form a joint which can articulate (at least to some degree) to permit bending of the base of the induction device into a desired shape or configuration. The kit may comprise instructions for assembling the individual induction devices into a larger induction device and/or for using the induction device to sustain a plasma or other ionization/atomization source.

Figure 24A:
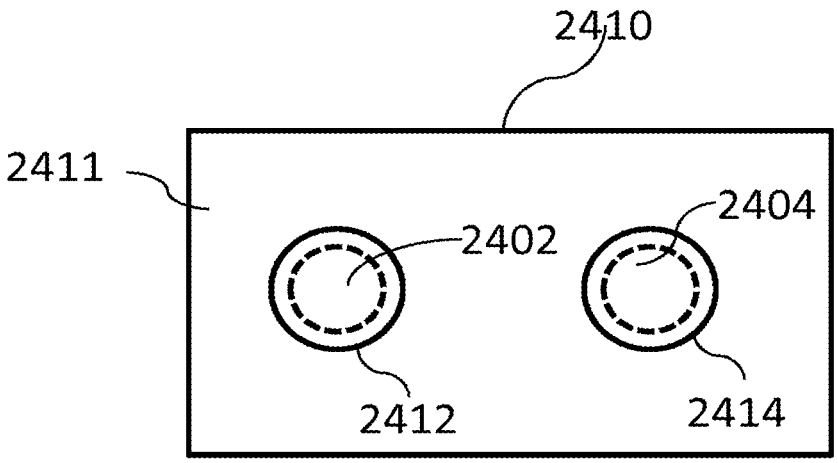
FIGS. 24A-24D are top view illustrations of couplers that can be used to fix the position of adjacent radial fins on adjacent radial coils, in accordance with certain configurations.
Figure 24B:
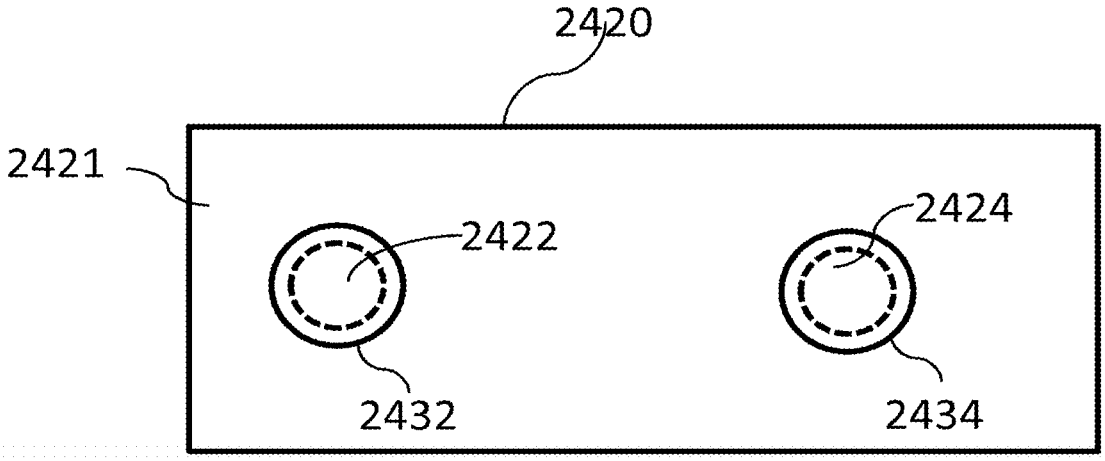

In certain instances, adjacent fins on adjacent coil turns can be fixed in position using one or more removable spacers that engage the adjacent fins. Referring to FIG. 24A, an illustration of a spacer 2410 installed over adjacent fins 2402, 2404 on an induction device is shown. In particular, the spacer 2410 comprises a body 2410 and apertures 2412 and 2414 than slide over the fins 2402, 2404, respectively. The spacer 2410 acts to hold the adjacent fins 2402, 2404 in place in the coil. In addition, the length of the spacer can be used to adjust the coil-to-coil spacing in the induction device. For example and referring to FIG. 24B, a two hole radial fin spacer 2410 is shown that slides over fins 2422, 2424. The apertures 2432, 2434 are spaced with a wider spacing in the body 2421 than the apertures 2402, 2404 in the body 2411. This wider spacing results in increased separation in the coil that includes the fin 2422 and the coil that includes the fin 2424. If desired, a smaller spacing between apertures of a spacer can be present to reduce the coil-to-coil spacing.

Figure 24C:
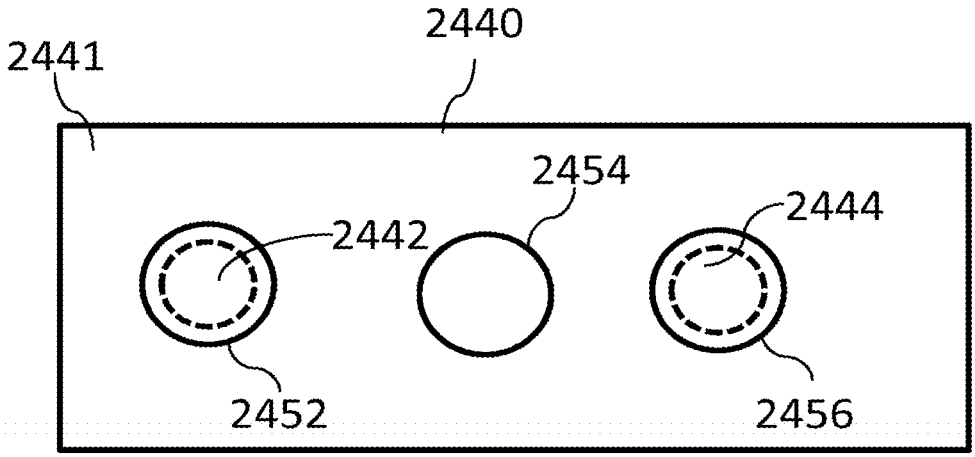
Figure 24D:
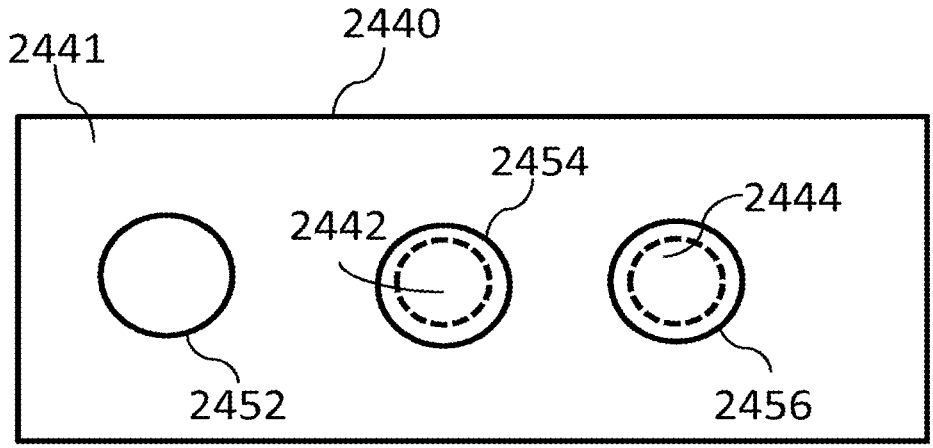

In some instances, a three hole spacer can be used to fix the spacing between adjacent fins. Referring to FIG. 24C, a three hole spacer 2440 is shown that comprises a body 2441 and three apertures 2452, 2454 and 2456. In FIG. 24C, adjacent radial fins 2442, 2444 have been inserted into the apertures 2452 and 2456 and aperture 2454 remains open. If desired, however, one of the fins could instead be inserted into the aperture 2454 and one of the other apertures 2452, 2456 could remain open. For example, FIG. 24D shows a configuration where the aperture 2452 remains open and fins 2442, 2444 are present in apertures 2454 and 2456. The coil-to-coil spacing provided using the spacer configuration of FIG. 24D would be larger than the coil-to-coil spacing provided in the configuration of FIG. 24C (assuming the same length for the body 2441). While two and three hole spacers are shown in FIGS. 24A-24D, more than three holes may be present in a spacer. For example, a spacer can be configured to permit radial fins running along the entire induction device to be engaged. Where the induction device comprises four turns, a spacer with four holes can be used. Where an induction device comprises five turns, a spacer with five holes can be used. In other instances, more than a single spacer can be used in an induction device. For example, two or more separate spacers can be positioned at different areas.

Figure 25:
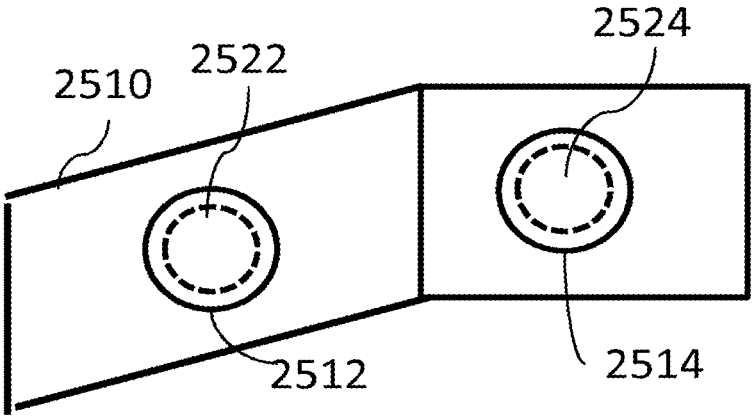
FIG. 25 is a top view illustration of a coupler than can be used to fix the position of radial fins on adjacent radial coils at an offset, in accordance with certain examples.
Figure 26A:
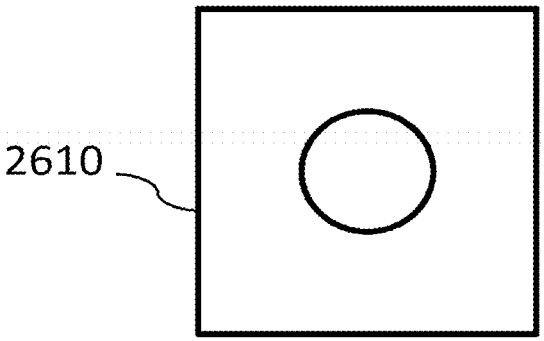
FIGS. 26A-26D are top view illustrations of spacer blocks that can be used and/or joined to each other to provide a desired spacing between coils of an induction device, in accordance with certain embodiments.
Figure 26B:
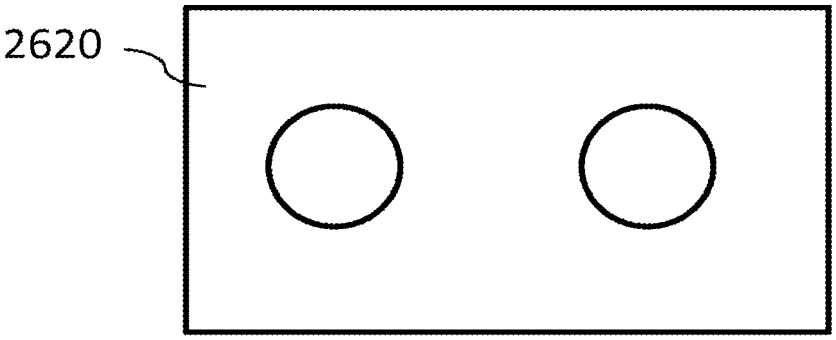
Figure 26C:
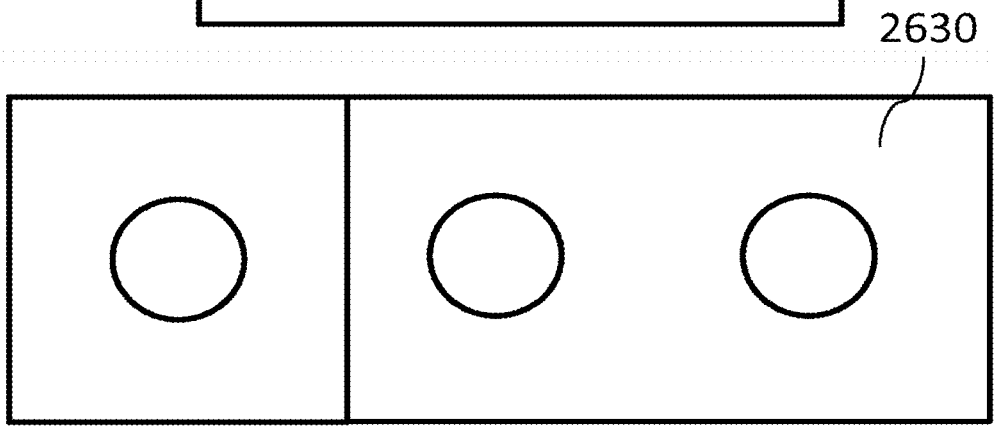
Figure 26D:
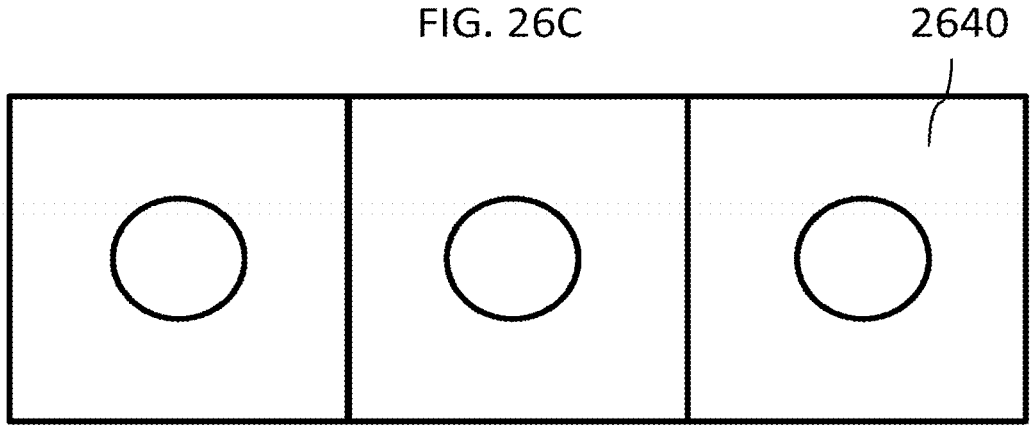

In some configurations, the spacer may be used to fix the position of adjacent radial fins in an offset position. For example and referring to FIG. 25, a top view of a spacer 2510 is shown that comprises two holes or apertures 2512, 2514 which are offset from each other. Radial fins 2522, 2524 are engaged by the holes 2512, 2514 respectively. The offset of the holes 2512, 2514 forces the radial fins 2522, 2524 to be offset from each other. Coil-to-coil spacing is also fixed when the coupler 2510 is engaged to the fins 2522, 2524.

In some instances, the spacers described herein may be present in block form to permit an end user to couple two or more spacers together to provide a desired spatial separation between adjacent coils. For example and referring to FIGS. 26A-26D, a one hole spacer block 2610 and a two hole spacer block 2620 can be coupled to each other to provide a three hole spacer block 2630. Alternatively, three of the on hole spacer blocks 2610 can be coupled to each other to provide a three hole spacer block 2640. Each of the spacer blocks may include suitable features, e.g., similar to the features described for the devices of FIGS. 23A-23C to permit coupling or joining of the spacer blocks to each other. The spacers can be packaged together in a kit comprising one hole spacer, two holes spacers and/or three hole spacers, and an end user can couple a suitable number of spacers to provide a desired coil-to-coil spacing.

In certain embodiments, the spacers described herein, e.g., those illustrative ones shown in FIGS. 24A-26D, can be produced using non-conductive materials. For example, the body of the spacers can be produced using one or more non-conductive plastics, alumina, polytetrafluoroethylene or other materials which can act as insulators. The exact number of spacers used and their configurations can vary. In some embodiments, a spacer may comprise a similar number of apertures as the number of coils present in the induction device. In other instances, two or more spacers each with fewer holes than the number of coils can be used, e.g., 2 two hole spacers can be used in a three coil induction device with the first spacer bridging the first and second coils and the second spacer bridging the second and third coils. Where two or more spacers are used, the spacer may be offset from each other a desired number of degrees, e.g., 45 degrees, 60 degrees, 90 degrees, 120 degrees, 150 degrees, 180 degrees or any value in between these illustrative values. If desired, three, four or more separate spacers may also be used. In some instances, a one hole spacer may be engaged to adjacent radial fins to provide a desired coil-to-coil spacing without locking the adjacent radial fins to each other, e.g., the one hole spacer permits some flexibility in the coils.

Certain specific examples are described below to illustrate further some of the novel aspects, embodiments and features described herein.

Example 1

Figure 27B:
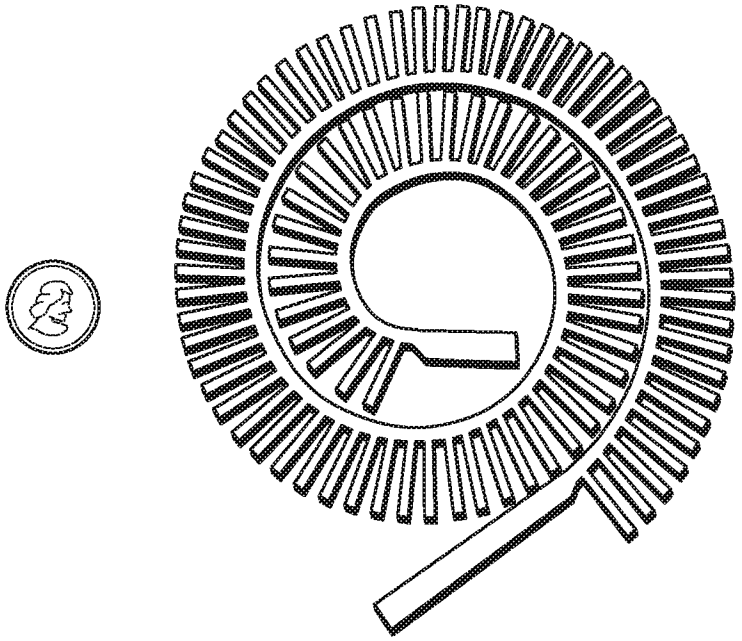
FIG. 27B shows a black and white line drawing produced from a photograph of a finned, aluminum alloy induction device, in accordance with certain configurations.
Figure 27A:
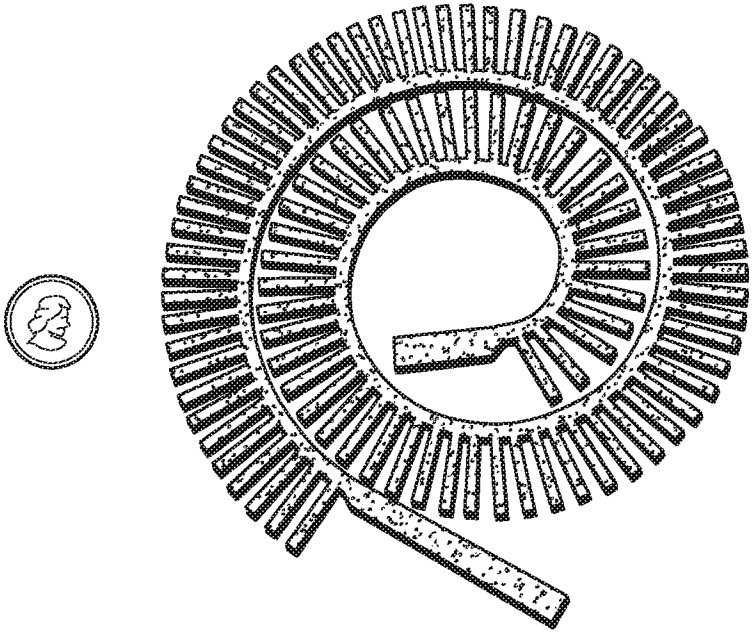
FIG. 27A shows a black and white line drawing produced from a photograph of a finned, copper induction device

Referring to FIGS. 27A and 27B, black and white line drawings produced from two photographs of coiled, finned induction devices are shown. Each induction device was produced from metal sheet (125 mil thick copper for the induction device of FIG. 27A and 125 mil thick aluminum 1100 alloy for the induction device of FIG. 27B). The induction device is then bent into the coiled configuration shown. A drawing of a penny is shown in each black and white line drawing for scale. The conducting path has a (substantially) square cross section so that it can be bent easily in any direction. The current flows allow the flat surface of the square cross section to reduce/minimize current crowding.

Example 2

Figure 28B:
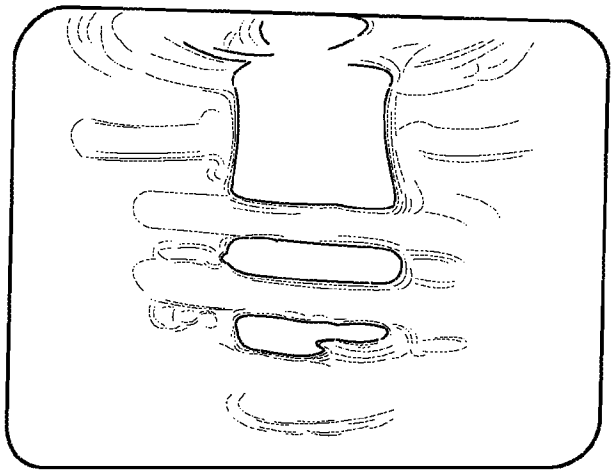
FIG. 28B is a black and white line drawing produced from a photograph showing a plasma sustained using a copper helical induction coil, in accordance with certain configurations.
Figure 28A:
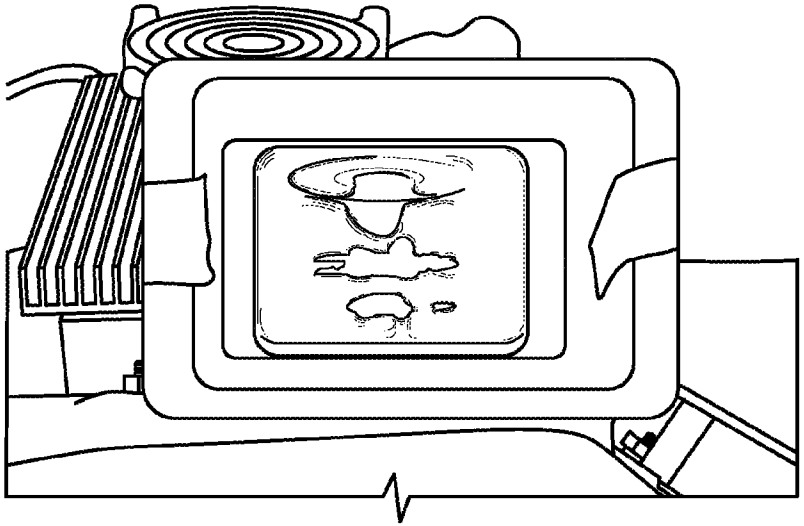
FIG. 28A is a black and white line drawing produced from a photograph showing a plasma sustained using the finned, aluminum alloy induction device

The aluminum finned induction device of FIG. 27B was used to sustain a plasma. A 3-turn copper load coil from a NexION instrument was also used for comparison. The plasma produced using the finned induction device (FIG. 28A) was similar to the plasma produced using the helical copper load coil (FIG. 28B).

Example 3

ICP-MS (Inductively coupled plasma-mass spectrometry) measurements were performed using numerous metal species, a conventional copper helical induction coil and a finned induction coil (referred to in FIG. 29 as a "Pine Cone Load Coil"). A plasma gas flow rate of 14 Liters/minute was used with the finned induction device, whereas a plasma gas flow of 17 liters/minute was used with the helical load coil. Measurements of ions with the finned induction device were comparable to those obtained with the helical load coil even though a lower amount of plasma argon gas was being used with the finned induction device.

Example 4

Figure 30B:
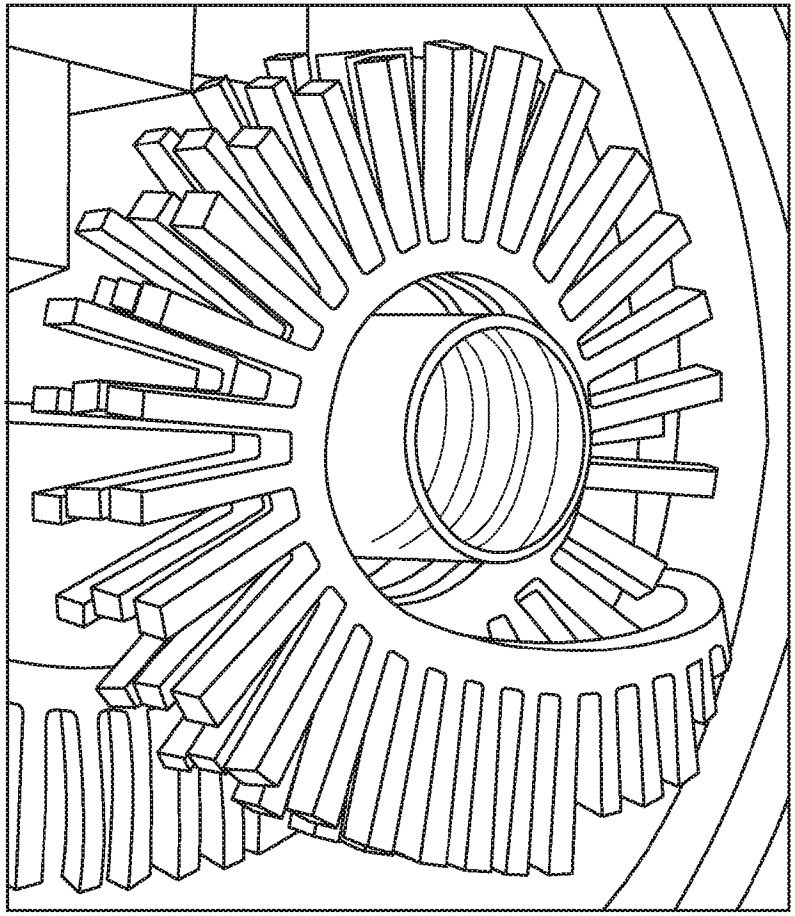
FIG. 30A is a black and white line drawing produced from a photograph showing a finned induction device and torch after 1 hour of continuous use and FIG. 30B is a black and white line drawing produced from a photograph showing the same finned induction and torch after 5 hours of continuous use, in accordance with certain configurations.
Figure 30A:
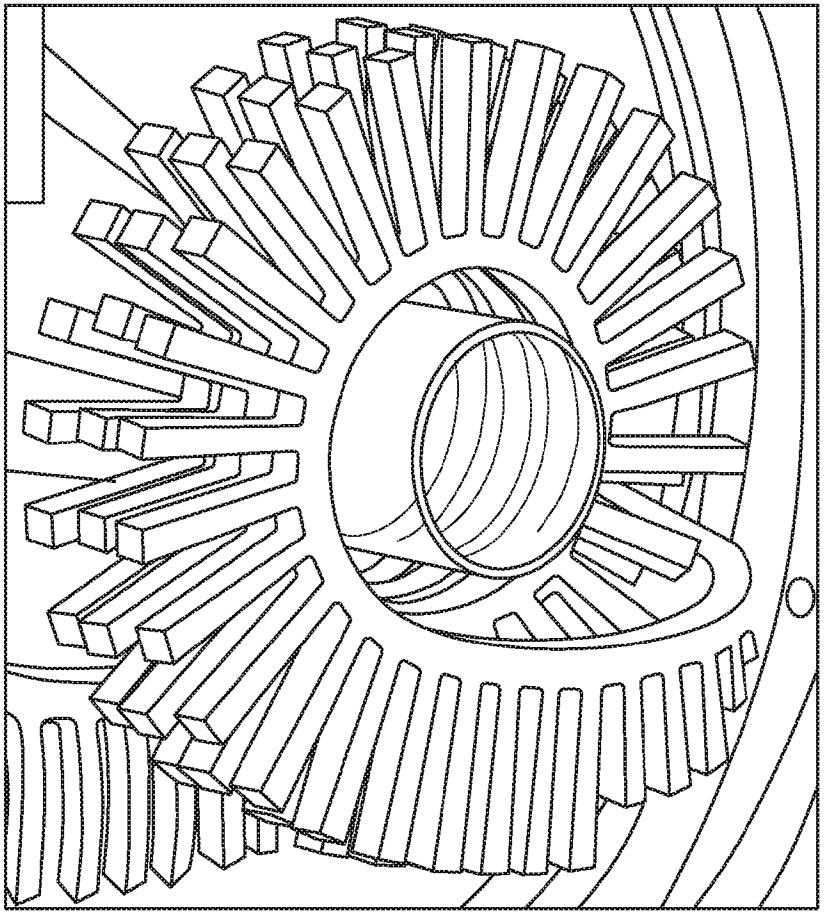

The finned, aluminum induction device was ran continuously for 1 hour (see FIG. 30A) and for 5 hours (FIG. 30B) to determine if any oxidation of the device or devitrification of the torch would be observed. The plasma argon gas flow rate was 11 Liters/minute. No signs of devitrification of the torch were observed. The induction device remained shiny and did not exhibit any substantial oxidation after 5 hours.

Example 5

Figure 31:
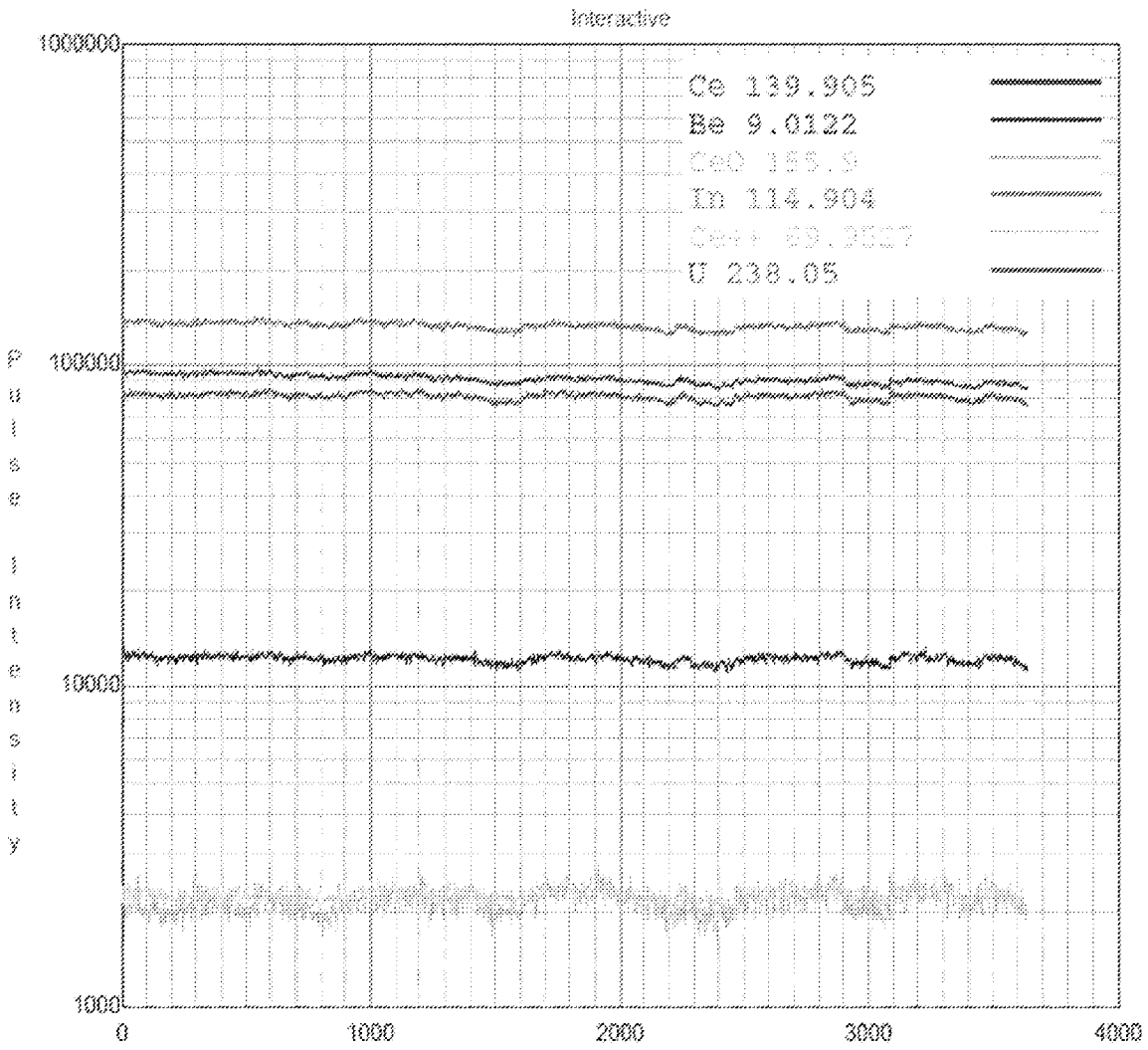
FIG. 31 is a graph showing the signal intensity of various metal species over time (in seconds), in accordance with certain configurations.

The mass spectrometry signal from various metal species (Ce, Be, CeO, In, Ce++ and U) was monitored over about an hour using the finned aluminum induction device to determine stability. The plasma argon gas flow rate was 11 Liters/minute. As can be seen in the graph of FIG. 31 (time shown in seconds), the signal was substantially constant for each metal species over a period of about 1 hour. From top to bottom of the graph in FIG. 31, the order of the curves is In, Ce, U, Be, Ce++ and Ce.

When introducing elements of the examples disclosed herein, the articles "a," "an," "the" and "said" are intended to mean that there are one or more of the elements. The terms "comprising," "including" and "having" are intended to be open-ended and mean that there may be additional elements other than the listed elements. It will be recognized by the person of ordinary skill in the art, given the benefit of this disclosure, that various components of the examples can be interchanged or substituted with various components in other examples.

Although certain aspects, examples and embodiments have been described above, it will be recognized by the person of ordinary skill in the art, given the benefit of this disclosure, that additions, substitutions, modifications, and alterations of the disclosed illustrative aspects, examples and embodiments are possible.

The invention claimed is:

1. A device for sustaining an ionization source in a torch comprising a longitudinal axis along which a flow of gas is introduced during operation of the torch, the device comprising:

a base configured to provide a coil comprising a first coil turn and a second coil turn to provide an inner aperture formed from the first and second coil turns, in which the inner aperture is constructed and arranged to receive a body of the torch; and a first radial fin coupled to the first coil turn and a second radial fin coupled to the second coil turn, in which the device is configured to provide radio frequency energy to the body of the torch to sustain the ionization source within the torch.

2. The device of claim 1, in which the first radial fin is oriented non-parallel to the longitudinal axis of the torch and extends away from the aperture formed by the base.

3. The device of claim 2, in which the first radial fin is orthogonal to the longitudinal axis of the torch.

4. The device of claim 1, in which the position of the first radial fin on the base is adjustable without decoupling the radial fin from the base.

5. The device of claim 4, in which the first radial fin couples to the base through a fastener.

6. The device of claim 1, in which the first radial fin is integrally coupled to the base.

7. The device of claim 2, further comprising a plurality of radial fins coupled to the first coil turn.

8. The device of claim 7, in which at least two of the radial fins coupled to the first coil turn comprise the same angle with respect to the longitudinal axis of the torch.

9. The device of claim 7, in which each of the plurality of radial fins coupled to the first coil turn is angled at substantially the same angle to the base when the base is not coiled.

10. The device of claim 7, in which at least two of the plurality of radial fins coupled to the first coil turn are angled at a different angle to the base when the base is not coiled.

11. The device of claim 7, in which at least two of the plurality of radial fins coupled to the first coil turn have a different cross-sectional shape.

12. The device of claim 1, in which the first radial fin comprises at least one aperture in the fin.

13. The device of claim 12, in which the aperture is configured as a through hole that is positioned substantially parallel to the longitudinal axis of the torch.

14. The device of claim 12, in which the fin aperture is angled toward the aperture formed by the base.

15. The device of claim 1, further comprising a plurality of radial fins coupled to the first coil turn and a plurality of radial fins coupled to the second coil turn, wherein at least two of the radial fins comprise an aperture in the fins, in which the apertures in the two radial fins are constructed and arranged differently.

16. The device of claim 1, in which the first radial fin is oriented non-parallel to the longitudinal axis of the torch and extends inward within the aperture formed by the base.

17. The device of claim 16, in which the first radial fin is orthogonal to the longitudinal axis of the torch.

18. The device of claim 16, further comprising a plurality of radial fins coupled to the first coil turn, in which each of the plurality of radial fins is oriented non-parallel to the longitudinal axis of the torch and each of the plurality of fins extends inward within the aperture formed by the base.

19. The device of claim 16, further comprising a plurality of radial fins coupled to the first coil turn, in which each of the plurality of radial fins is oriented non-parallel to the longitudinal axis of the torch and at least one radial fin extends inward within the aperture formed by the base.

20. The device of claim 1, further comprising a plurality of radial fins coupled to the first coil turn, in which at least one radial fin of the plurality of radial fins extends away from the aperture formed by the base and at least one radial fin of the plurality of radial fins extends inward within the aperture formed by the base.

* * * * *